United States Patent [19]

Kawakubo et al.

[11] 4,437,756

[45] Mar. 20, 1984

[54] DOUBLE-SIDE IMAGE FORMING APPARATUS

[75] Inventors: Kazuo Kawakubo, Chigasaki; Katsushi Furuichi, Yokohama; Kiyokazu Namekata, Machida; Hidetoshi Tanaka, Musashino; Yashikuni Tohyama, Yokohama; Toshirou Kasamura; Tomohiro Aoki, both of Yokohama; Toshio Honma, Tokyo, all of Japan

[73] Assignee: Canon Kabushiki Kaisha, Tokyo, Japan

[21] Appl. No.: 402,579

[22] Filed: Jul. 28, 1982

Related U.S. Application Data

[63] Continuation of Ser. No. 219,510, Dec. 23, 1980, abandoned.

[30] Foreign Application Priority Data

| | | | |
|---|---|---|---|
| Dec. 28, 1979 | [JP] | Japan | 54-171343 |
| Dec. 28, 1979 | [JP] | Japan | 54-171344 |
| Dec. 28, 1979 | [JP] | Japan | 54-171345 |
| Dec. 28, 1979 | [JP] | Japan | 54-171346 |

[51] Int. Cl.[3] ..... G03G 15/00

[52] U.S. Cl. ..... 355/14 R; 355/23; 355/26

[58] Field of Search ..... 355/14 R, 14 C, 23, 355/24, 26

[56] References Cited

U.S. PATENT DOCUMENTS

| | | | |
|---|---|---|---|
| 3,980,406 | 9/1976 | Lang | 355/24 |
| 4,123,155 | 10/1978 | Hubert | 355/26 |
| 4,229,101 | 10/1980 | Hamlin et al. | 355/23 X |

*Primary Examiner*—Richard L. Moses

*Attorney, Agent, or Firm*—Fitzpatrick, Cella, Harper & Scinto

[57] ABSTRACT

A double-side image forming apparatus has input unit for entering the number of desired image formation for forming images on both faces of a sheet-shaped image bearing member and a storage section for storing said image bearing member after image formation on a first face thereof. The apparatus is adapted, when the image formation on the first face of said image bearing members is interrupted before the completion of said desired number of image formations, to conduct in continuation the image formation on the second face of the image bearing members stored in said storage section.

17 Claims, 31 Drawing Figures

M1
M2
DC
T
AC
SSR
SSR
HVT1
HVT2
DHP
CP
OHP
OBP
P·I
CL1
CL2
CL3
CL4
NO SHT (UP)
NO SHT (LOW)
NO SHT (BOTH)
JPF
I/O - 3
I/O - 2
CS
DB
R/W
Res
Φ
G
4

RAM MAP (000 — OFF)

| #'0' | 0 | 1 | 2 | 3 | 4 | 5 | 6 | 7 |
|---|---|---|---|---|---|---|---|---|
| 0 | WR0 COPY FLAG | | WA0 | | WR1 | | WA1 | |
| 1 | WR4 | | WA4 | | WR5 | KEY COUNTER WAIT ORIGINAL INTRPT. EXCHANGE | WA5 | |
| 2 | CNT1 | NO. OF SET | | JAM SORTER JAM TONER NO SHEET | | | SIDE 1 SIDE 2 REPT. TRAY EXH. KEY | 1.0 0.7 0.6 DARK |
| 3 | CNT2 | NO. OF COPY | | | | SIDE 1 SAVE (MODE 1) | | |
| 4 | CNT3 | NO. OF FINISH | | | | SIDE 2 SAVE (MODE 2) | | |
| 5 | CNT4 | SET SAVE | | | | INTERRUPTION SAVE (MODE INTRPT.) | | |
| 6 | CNT5 | COPY SAVE | | | | | | |

FIG. 5A

| | JAMS | JAM1 | JAM2 | STOPS | STOP1 | STOP2 | PEMPS | PEMP1 |
|---|---|---|---|---|---|---|---|---|
| 7 | | | | | | | | |
| 8 | | | | | | | | |
| 9 | | | | | | | | |
| A | | | | | | | | |
| B | | | | | | | | |
| C | | | | | | | | |
| D | | | | | | | | |
| E | | | | | | | | |
| F | | | | | | | | |

FIG. 5C

FIG. 5D

| PEMP2 | IRPT INTER-RUPTION | KEY LIMIT FLAG | | | | | | |
|---|---|---|---|---|---|---|---|---|
| | | | | | | | | |
| | | | | | | | | |
| | | | | | | | | |
| | | | | | | | | |
| | | | | | | | | |
| | | | | | | | | |
| | | | | | | | | |
| | | | | | | | | |

POWER ON
I/O CLEAR
RAM CLEAR
STEP 1
SET NUMBER ← 1
COPY NUMBER ← 0
TO SET MODE IN:
MAGNIFICATION ; 1
DENSITY ; ORDINAL
OUTLET ; TRAY
MODE ; SINGLE
CASSETTE ; LOWER
STEP 2
C
KEY INPUT ?
NO
YES
KEY INPUT READING KEY

KEY

LIMIT FLAG ?
YES
NO
NUMERIC KEY
YES
NO
OUTLET KEY
YES
NO
DENSITY KEY
YES
NO
REDUCTION KEY
YES
NO
CASSETTE SELECTION
YES
NO
SET DATA TO RAM
UP ; UPPER SET
DOWN; LOWER SET
C L
YES
NO
CLEAR SET NUMBER
RESET LIMIT FLAG
CPY
NO
YES
COPY FLAG SET
A
RTN

DOUBLE-SIDE IMAGE FORMING APPARATUS

This is a continuation of application Ser. No. 219,510 filed Dec. 23, 1980, now abandoned.

BACKGROUND OF THE INVENTION

1. Field of the Invention

The present invention relates to a double-side image forming apparatus capable of forming images on both faces of a sheet-shaped image bearing member.

2. Description of the Prior Art

In conventional image forming apparatus such as copiers, the reproduced image is generally formed only on one face of the sheet-shaped image bearing member or copy sheet. However such copy sheets, when stored in bulk, require twice space and weight in comparison with double-faced documents such as books. Double-side image forming apparatus are required also in consideration of the economy in resources, labor power and cost.

In the following description the present invention will be explained by a double-side copier as an example of such apparatus. In a copier employing image transfer process, double-sided copying can be achieved in the following systems.

In a first process, different images are formed respectively on two photosensitive drums for top face and bottom face, and transferred to both faces of the copy sheet.

This system, though simple in principle, is disadvantageous in requiring a large expensive apparatus because of the necessity for two independent copying processes.

In a second system a first image formed on a photosensitive drum is transferred to an intermediate drum for temporary storage, then a second image is again formed on the photosensitive drum, and said images are transferred respectively from said intermediate drum and photosensitive drum to the copy sheet. This system requires only one copying process but is disadvantageous in different image quality between the top face and the bottom face.

In a third system the ordinary one-side copying is made on a face of the copy sheet, and the completed copy sheet is inverted and returned to the original paper feed section or another paper feed section for copying again on the bottom face.

In contrast to the first or second system associated with the drawback in cost and dimension of the apparatus or in the image quality, the third system is considered most practical for realizing a simple and compact double-side copier, requiring only one copying process same as in the one-side copying.

However the third system is often confronted by other troubles such as paper jamming because each copy sheet has to go through a longer path in comparison with the ordinary one-side copying and also because each copy sheet of which surface conditions have been modified by the steps of image transfer and fixing has to be again subjected to the steps of paper feeding, image transfer and fixing for the second time.

SUMMARY OF THE INVENTION

The object of the present invention is to provide a double-side image forming apparatus capable of eliminating these drawbacks, and more specifically a double-side image forming apparatus having input means for entering the number of desired image formations for forming images on both faces of a sheet-shaped image bearing member and a storage section for storing said image bearing member after image formation on a first face thereof, said apparatus being adapted, when the image formation on the first face of said image bearing members is interrupted before the completion of said desired number of image formations, to conduct in continuation the image formation on the second face of the image bearing members stored in said storage section.

Another object of the present invention is to provide a double-side image forming apparatus capable of conducting image formation in a first mode on a first face of the sheet-shaped image bearing member, then storing said image bearing member in a storage section and then conducting image formation on a second face in a second mode, being featured in interrupting image formation in the second mode in response to an interruption signal and maintaining said second mode until the receipt of an image formation instruction signal.

BRIEF DESCRIPTION OF THE DRAWINGS

FIGS. 5, 5A, 5B, 5C, 5D are a memory domain chart of the random access memory shown in FIG. 3.

DESCRIPTION OF THE PREFERRED EMBODIMENTS

Now the present invention will be clarified in detail by the description of embodiments thereof to be taken in conjunction with the attached drawings.

Figure 1:
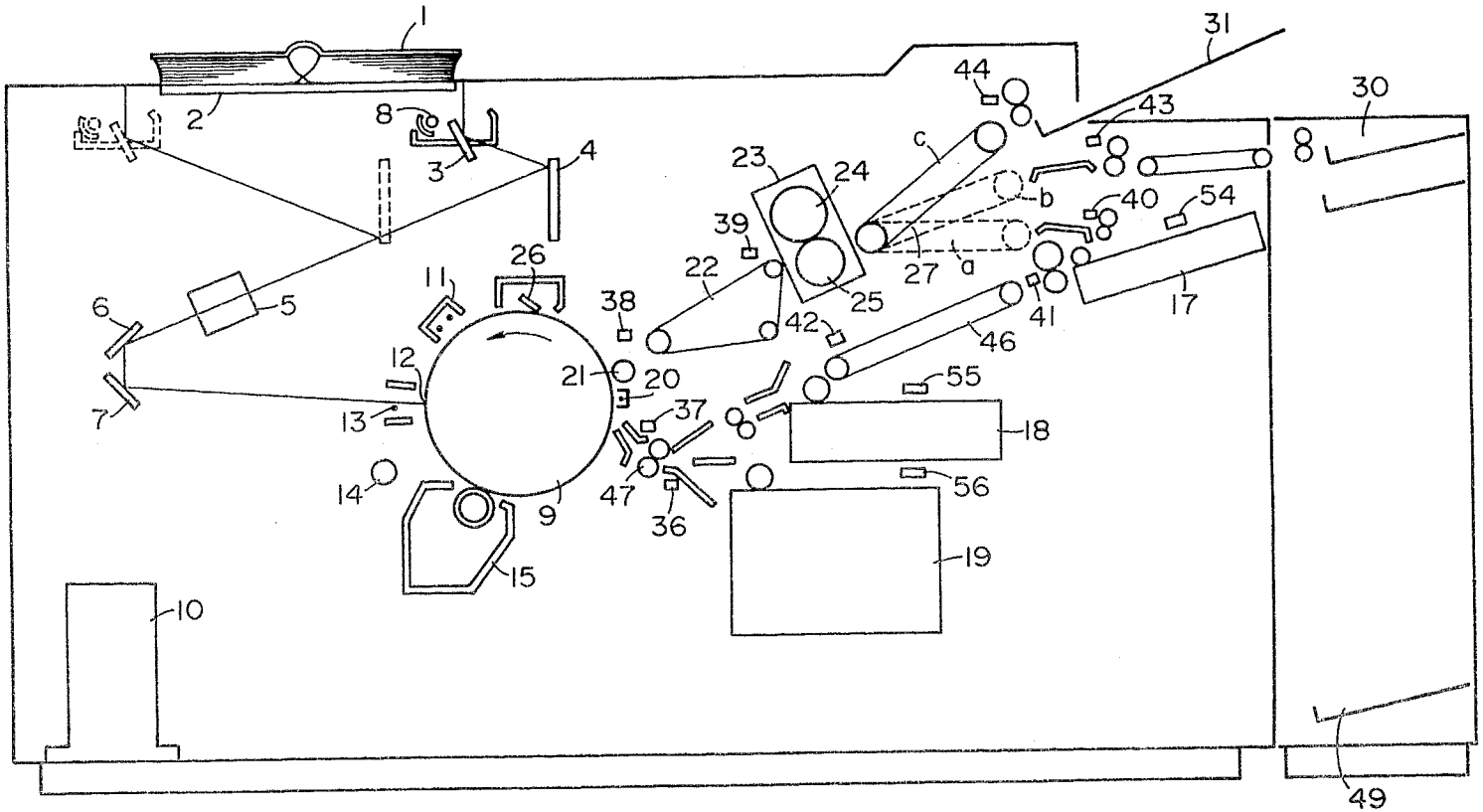
FIG. 1 is a cross-sectional view of a double-side copier in which the present invention is applicable.
Figure 2:
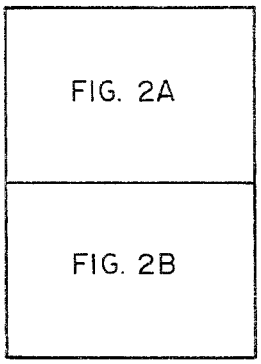
FIGS. 2, 2A and 2B are plan views of the display and control unit of the copier shown in FIG. 1.

FIG. 1 shows an embodiment of the present invention in a cross-sectional view illustrating the sheet transport path in a double-side copier, of which control section is shown in FIG. 2.

At first there will be explained the function of the copier in the ordinary single-side copying.

Referring to FIG. 1, an original 1 is placed on a transparent plate 2 of the original carriage, and an exposing optical system is composed of movable mirrors 3, 4, a lens 5 and fixed mirrors 6, 7. Thus, the original 1 is slit exposed by the displacement of the movable mirror 3 structured integrally with an illuminating lamp 8 and the displacement of the movable mirror 4 in the same direction but at a half speed to maintain a constant optical path length and the reflected light from the original is focused on a photosensitive drum 9 through said lens 5 and fixed mirrors 6, 7.

On the periphery of the photosensitive drum 9 there is provided a photoconductive layer covered with a transparent insulating layer to constitute a photosensitive member, which is at first charged positively by a positive charger 11 receiving a positive high voltage from a high voltage source 10.

In an exposure station 12 the image of the original 1 illuminated by the lamp 8 is exposed to the drum 9 through the movable mirrors 3, 4, lens 5 and fixed mirrors 6, 7.

Simultaneously with the exposure of original image the drum 9 is subjected to an AC discharge by an AC discharger 13 receiving an AC high voltage from the high voltage source 10. Subsequently an electrostatic latent image is formed on the photosensitive drum by a flush exposure by a whole-surface exposure lamp 14 and introduced into a developing station 15.

Said latent image is rendered visible by toner development with a magnetic sleeve. The copy sheet 16 is supplied from an intermediate tray 17 or a first paper feed station, both structured as cassettes, or a second paper feed station 19 structured as a deck having an automatic elevator and capable of supporting a stack of copy sheets. Said intermediate tray 17 is also utilized as the paper feed station in the double-side copying as will be further explained later.

The copy sheet 16 supplied from the paper feed station 17, 18 or 19 is brought into contact with the drum 9, and the developed image thereon is transferred onto the copy sheet by a positive discharge from a transfer charger 20 powered by the high-voltage source 10. The copy sheet after the image transfer is separated from the drum 9 in a separating station 21 and guided through a conveyor 22 to a fixing station 23.

Said fixing station 23 is provided with a heated fixing roller 24 and a rubber-clad pressure roller 25 between which the copy sheet is passed to fix the toner image thereto by heat and pressure.

On the other hand the drum surface is cleaned by a contacting blade 26 for removing the remaining toner, and is thus prepared for the succeeding imaging cycle. The copy sheet 16 passing through the fixing station 23 is advanced to a conveyor 27 which is automatically switchable to a transfer position (a) (shown by full line) to the intermediate tray 17 for double-side copying, a transfer position (b) to a sorter 30 or a transfer position (c) to a copy sheet tray 31 (the latter two being shown by broken lines) in response to the mode selection by a "tray" button 77 or a "sorter" button 78 shown in FIG. 2. The foregoing process is automatically conducted by the actuation of a copy start button 35 after the entry of a desired copy number by numeral keys 34. Also as shown in FIG. 2, there are provided display units for indicating the selected copy number and the completed copy number. The upper display unit 61 indicates the selected copy number entered by the numeral keys 34, while the lower display unit 62 indicates the number of completed copies. For example, in case 20 copies are instructed by the numeral keys 34, the upper display unit 61 indicates "020" while the lower display unit 62 is step advanced from "000" to "001", "002" and so on to "020" when the copying operation is terminated. Instead of such so-called addition type display, the display unit 62 may have a subtraction type display in which the displayed number is decreased from "020" to "019", "018" and so on and finally to "000". Though the display unit 62 may be realized in the addition type or subtraction type in this manner, the following description will be based on the addition type display.

Along the above-explained sheet transport path there are provided paper jamming detectors 36–44 to perform the following functions in case of a paper jam detection:

(I) In case of a paper jam detection by the detector 36, 37 or 38, the copy sheets present in the transport path after the separating station 21 (separating station itself not included) are ejected to the preselected outlet, for example the tray or the sorter. The sheet eventually present on the conveyor 22 is ejected after the normal fixing step, but all other process steps such as exposure, charging, development and image transfer are interrupted, and all the copy sheets thus ejected are regarded as normal copies. The copy sheets remaining in the apparatus are to be removed according to the jam display, and are not counted as the completed copies.

(II) In case a sheet jamming is detected by the detector 39, 43 or 44, the copy sheets present after said detector are ejected in the normal manner but the other process steps are all interrupted. The counting of completed copies and the jam display are performed in the same manner as in the case (I).

Also the intermediate tray 17, first paper feed station 18 and second paper feed station 19 are respectively provided with detectors 54, 55 and 56 for detecting the presence of copy sheets.

Now there will be explained the procedure of double-side copying.

In the present embodiment standard modes are predetermined for various copying conditions for achieving a standard copying such as "single side" copy with a "normal" density for "tray" ejection in FIG. 2, and are automatically selected at the turning on of the power supply to the apparatus. Besides any other mode eventually selected automatically returns to said standard mode in case the copy start button 35 is not actuated for a determined period. In this manner the apparatus can always be maintained in a state convenient for the operator.

Upon actuation of a "double-side" button 80 for selecting the double-sided copying mode, the apparatus is readied for a first-face copying mode in which a lamp PL9 is lighted to indicate the copying for the first side of the copy sheet, and the conveyor 27 is switched to the position (a). In the second-face copying to be explained later, a lamp PL10 is lighted to indicate the second-face copying, thus facilitating the control by the operator.

Copy mode selector buttons 71–82 are respectively provided thereabove with light-emitting diodes LED-1–LED12 for indicating the selected mode when said buttons are actuated.

The copying operation is initiated after the selection of other copying conditions and the entry of copy number, but, in the first-face copying in the double-side copy mode, the copy sheet supply cannot be made from the intermediate tray 17 but only from the first or second paper station 18 or 19. In case a copy sheet is already present in such first-face copying, a lamp PL11 is lighted to indicate a message "to remove the sheet in the intermediate tray", and the copying operation cannot be initiated until said sheet is removed by the operator.

After the start of the copying operation, all the mode selector buttons are disabled to prohibit the mode alteration, except a "stop" button 45. The process steps of exposure, development, image transfer and fixing are performed in the same manner as in the single-side copying, and the copy sheet 16 from the fixing station 23 is transferred through the conveyor 27 to the intermediate tray 17 is such a manner that the leading end of said copy sheet is housed at the rear end, opposite to the paper feed outlet, in said intermediate tray 17.

As shown in FIG. 1, the intermediate tray 17 is sloped downwards to the paper feed outlet, whereby the copy sheets contained therein are aligned by the weight thereof at said outlet to facilitate the paper supply at the subsequent second-face copying.

The first-face copying is completed when the copy sheets of the selected copy number are stored in the intermediate tray 17. At the same time the lamp PL10 is lighted to instruct the operator to place an original for the second-face copying, and the conveyor is switched to the predetermined outlet. In this state the copying conditions suitable for the second-face copying are selected, but the transfer to the single-side copying is disabled. In response to a copy start signal for the second-face copying, the copy sheets in the intermediate tray 17 are supplied in succession to a conveyor 46 and transported to the selected outlet while the process steps of exposure, development, image transfer and fixing are conducted in the same manner as in the first-face copying.

The image reproduced in said second-face copying is applied to the bottom face of each copy sheet already having an image on top face thereof formed in the preceding first-face copying. Upon completion of the second-face copying on all the copy sheets stored in the intermediate tray 17, the lamp PL10 is extinguished while the lamp PL9 is again lighted to indicate the first-face copying mode, thus preparing for the succeeding double-side copying operation. However, in case the succeeding double-side copying is not initiated within a determined period, the apparatus automatically returns to the normal single-side copying mode as explained in the foregoing. It is also possible to shift the apparatus to the single-side copying mode within said period by actuating the button 79.

As the copy sheets in the intermediate tray 17 may be disaligned in the direction perpendicular to the sheet advancing direction, the conveyor 46 is provided with an unrepresented mechanism for lateral registration, which, in cooperation with a registering roller 47, functions to supply the copy sheets to the image transfer step with exact registration in both directions.

Now, for the purpose of clarity of the following description, there will be given definitions of the terms "standard mode", "copy mode", "single-side copy mode" indicating the function in the single-side copying, and "first-face copy mode" and "second-face copy mode" in the first and second face copying in the double-side copying as follows:

"Copy mode" means various functions of the copier selectable by the operator, or, in the present embodiment, the functions shown in the control unit in FIG. 2.

"Standard mode" means a normal copying mode automatically selected at the turning on of the power supply to the copier or after the lapse of a determined period without copying operation, and includes the following conditions in the present embodiment:

| | |
|---|---|
| image magnification | 1:1 |
| copy density | normal |
| copy outlet | tray |
| copying | single-sided |
| copy number | 001 |
| completed copy number | 000. |

"Single-side copy mode": In the copying modes including the instruction of single-side copying, the conveyor 27 is automatically switched to a selected outlet (position (b) or position (c)) in response to thee copy start signal, and the copy sheet is supplied from the first or second paper feed station 18, 19 or the intermediate tray 17 and is ejected from the selected outlet through the conveyor 27 after the process steps of exposure, development, image transfer and fixing are performed.

"First-face copy mode": Upon selection of the "double-side copy" there is given an indication for the "first-face copy", and the conveyor 27 is switched to the position (a) in response to the copy start signal after the selection of other copying modes. The copy sheet is supplied from the first or second paper feed station 18, 19 selected in advance, and advanced to the intermediate tray 17 through the conveyor 27 after the process steps of exposure, development and image transfer.

After the copy sheets of the selected copy number (though there exist certain exceptions as will be explained later) are stored in the intermediate tray 17, the apparatus is stopped and the display for the "second-face copy" is automatically given.

"Second-face copy mode": After the selection of copying modes (except for the outlet, copy number and single-side or double-side which are already selected prior to the first-face copying) and in response to the copy start signal, the conveyor 27 is switched from the position (a) to the selected outlet position (b) or (c). The copy sheets are supplied from the intermediate tray 17 to receive on the second faces the images formed by the process steps of exposure, development, image transfer and fixing, and ejected to the selected outlet. After the ejection of copy sheets of the selected copy number (except for certain cases as will be explained later) the apparatus is stopped and the display for the "first-face copy" is given.

In the following explained are the procedures in case of sheet jamming or multiple sheet supply or for special instruction in the course of the double-side copying operation.

(I) In case the "stop" button 45 is actuated during the first-face copying, the copying operation is immediately terminated. The number of copy sheets having completed the first-face copying (number of sheets in the intermediate tray 17) is automatically displayed at the selected copy number for the second-face copying, and the lamp PL10 is lighted to shift the copier to the second-face copying mode. The actuation of "stop" button during the first-face copying becomes necessary principally in case of an erroneous selection in the copy number, image density or outlet, or an erroneously placed original document. If the copy number can be modified in this state for continuing the first-face copying and thus modified copy number is used as the selected copy number for the second-face copying, the number of copy sheets stored in the intermediate tray 17 becomes different from the selected copy number for second face.

Also it is not advisable to automatically use the sum of the number of copy sheets in the intermediate tray 17 and the newly selected copy number as the copy number for the second face, since the copy sheets in the intermediate tray 17 may not require the copying for the second face due to some errors in the first-face copying.

For these reasons, in response to the "stop" instruction during the first-face copying, the apparatus terminates the first-face copying at this point and is automatically shifted to the second-face copying mode, whereupon the second-face copying can be initiated if the copy sheets in the intermediate tray 17 are regarded as normal by the operator.

Also in case said copy sheets are regarded as erroneous, the first-face copying can be conducted again from the beginning after said copy sheets are removed from the intermediate tray 17. In such case said removal of the copy sheets is detected automatically to shift the apparatus to the first-face copy mode with a corresponding display.

In such case the selection of all the copy modes becomes enabled.

Said copy sheet removal from the intermediate tray 17 can be achieved either manually or by the actuation of a "removal" button 48 shown in FIG. 2, in response to which the paper transport mechanisms are activated to automatically transport the copy sheets from the intermediate tray 17 without the steps of exposure, development, image transfer and fixing through the conveyors 46, 22 and 27 in the position (b) or (c) to the tray 31 or a predetermined bin in the sorter 30. In the present embodiment the lowermost tray of the sorter 30 is assigned as a dust box 49 into which thus removed copy sheets are automatically supplied.

Also said tray 31 is provided with a sheet sorting function by the swinging motion of the tray as disclosed in the Japanese Patent Laid-Open Sho54-41732, and is set in said swinging motion at said copy sheet removal to separate such removed copy sheets from the normal copy sheets, whereby the operator can easily distinguish the erroneous copy sheets from the normal ones both in the tray 31 and the sorter 30.

(II) In case the copy sheets are exhausted in the first or second paper feed station 18, 19 during the course of the first-face copying, the first-face copying mode is terminated at this point in the same manner as the "stop" button 45 is actuated in the foregoing item (I), whereby the number of copy sheets stored in the intermediate tray 17 is automatically displayed as the selected copy number for the second-face copying mode and the lamp PL10 is lighted to shift the apparatus to the second-face copying mode for starting the second-face copying upon receipt of the copy start signal. The completed copy number is step advanced with the progress of the copying cycles, and the second-face copying mode is terminated when the completed copy number becomes equal to the selected copy number. Upon completion of said second-face copying mode, there are displayed the originally selected copy number and the completed copy number, and the lamp PL9 is lighted to indicate the first-face copying mode, in which the operator can demand the deficient copies in the following procedure.

The apparatus is made ready for the copying cycles for such deficient copies by replenishing copy sheets to the first or second paper feed station 18, 19 in which the copy sheets are exhausted. The first-face copying is initiated by the actuation of the copy start button 35, and the number of copies is added to the completed copy number mentioned above. When the completed copy number becomes equal to the selected copy number mentioned above, the apparatus terminates the first-face copying mode and is shifted to the second-face copying mode, in which given are displays of the originally selected copy number and the completed copy number same as those displayed prior to the start of the second first-face copying mode.

Then the second-face copying is initiated by the copy start signal whereby the number of copies is added to the above-mentioned completed copy number, and said second-face copying mode is terminated when said completed copy number becomes equal to the selected copy number, thus providing the double-sided copies of a number initially selected.

For the purpose of clarity, the above-explained procedure will be explained again by the following numerical example. It is now assumed that 20 copies are required but the paper feed station contains only 15 copy sheets. In the initial first-face copying mode, "20" and "0" are displayed respectively for the selected copy number and the completed copy number. After the copying cycles are initiated by the copy start signal, said displays are step advanced in the order of "20-1", "20-2", . . . "20-11", "20-12", "20-13", . . . ), and the completed copy sheets are introduced into the intermediate tray 17. The copy sheets in the paper feed stations are exhausted when displays "20-15" are obtained, whereby the first-face copying mode is terminated.

Thus the second-face copying mode is automatically enabled, and simultaneously said displays are changed from "20-15" to "15-0" indicating a newly selected copy number of 15 copies.

The second-face copying cycles are initiated by the subsequent copy start signal, whereby said displays vary in the order of "15-1", "15-2", . . . ), "15-11", "15-12", "15-13", . . . with the progress of copying cycles, and the copy sheets having double-sided images are ejected onto the tray 31 or into the sorter 30.

Said second-face copying mode is terminated when the completed copy number becomes equal to the selected copy number, i.e. when the displays become "15-15".

Thus the copier is automatically shifted to the first-face copying mode, and the displays are shifted from "15-15" to "20-15", indicating a deficiency of 5 copies with respect to the initially selected 20 copies.

The copying cycles for such deficient 5 copies can be initiated by replenishing the exhausted paper feed station with the copy sheets.

The copying cycles in the second first-face copying mode are initiated by the subsequently copy start signal, whereby the displays progressively change in the order of "20-16", "20-17", . . . and the completed copies are introduced into the intermediate tray 17.

Said first-face copying mode is terminated when the completed copy number becomes equal to the selected copy number, i.e. when the displays become "20-20".

Thus the second-face copying mode is enabled, and the displays are changed from "20-20" to "20-15". The second-face copying cycles in the second second-face copying mode are initiated by the subsequent copy start signal, whereby the displays are step increased in the order of "20-16", "20-17", . . . In this manner the copy sheets having double-sided images are ejected from the apparatus.

Said second-face copying cycles are terminated when the completed copy number becomes equal to the selected copy number, i.e. when the displays become 37 20-20", thus completing all the required copies.

In this manner the copying operation can be conducted in continuation even when the copy sheets are exhausted during the course of the copying operation, and it is to be noted that the present invention is not limited to the manner of displays as explained in the foregoing example. For example at the shift from the first-face copying mode to the second-face copying mode due to the absence of copy sheet in the paper feed station, the displays may be so designed as to change from "20-15" to "20-0" instead of "15-0".

Also at the shift from the second-face copying mode to the first-face copying mode for the second time, the displays may be so designed as to change from "15-15" or from "20-15" in the above-mentioned modified displays to "20-15" or to "5-0".

Finally at the shift from the second first-face copying mode to the second second-face copying mode, the displays may be so designed as to change from "5-5" to "5-0". Furthermore it is naturally possible to employ the subtraction type displays.

As will be apparent from the foregoing (I) and (II), the present embodiment is so structured, when the image forming operation is interrupted before the completion of the image forming cycles of a number selected in advance by the input keys, as to subsequently conduct the image forming operation on the second face of the image bearing members or copy sheets present in the intermediate tray. Such function is extremely advantageous in avoiding unnecessary waiting time since the second-face image formation can be immediately initiated even if the copy sheets are exhausted during the first-face image formation and the replenishment of copy sheets can be made during said second-face image forming operation.

(III) In case the "stop" button 45 is actuated during the second-face copying mode, the copying operation is interrupted but the displays for the copy numbers and the double-side copy mode are retained. Thus in response to the subsequent actuation of the copy start button 35, the copying operation is restarted and the number of copies is added to the display prior to the interruption.

On the other hand if the copy sheets are removed from the intermediate tray 17 in such case, the displays and the copying mode are automatically shifted to the first-face copying mode in the same manner as in the first-face copying mode explained in the foregoing.

Such actuation of the "stop" button 45 during the second-face copying operation will be required by the similar reasons as in the interruption of the first-face copying operation, but an automatic shift to the first-face copying mode allowing to select a new copy number will result in a difference between the number of copy sheets present in the intermediate tray 17 and the selected copy number.

For this reason the second-face copying mode is retained until the subsequent copy start signal in case of an interruption signal during the second-face copying operation. Consequently the copy sheets already having the image on the first face but not yet subjected to the image formation on the second face are stored as effective copy sheets in the intermediate tray 17.

(IV) In case of a paper jamming detected in the course of first-face copying operation, the function of the apparatus is similar to that in case of single-side copying. Thus, in case said jamming is detected by the detector 36, 37 or 38, the copy sheets presented after the separating station are stored in the intermediate tray 17 after the image fixing step.

On the other hand, in case said jamming is detected by the detector 38 or 39, the copy sheets present after the corresponding detector are advanced into the intermediate tray 17 while those present in front of the corresponding detector have to be removed from the apparatus.

When the copying operation is restarted, the number of copies is added to the displayed copy number at the interruption by jamming.

(V) In case of paper jamming in the course of second-face copying operation, the number of completed copies becomes deficient with respect to the selected copy number as some copy sheets have to be removed due to paper jamming.

The double-side copier of the present embodiment is designed to resolve such deficiency. After the jam state is eliminated, the copying operation is continued on all the copy sheets remaining in the intermediate tray 17, and, upon completion thereof, the apparatus returns automatically to the first-face copying mode while displaying the number of completed double-sided copies and the initially selected copy number and lights the lamp PL9 to show a message requesting the original for the first face, thus enabling the copying cycles for the deficient copies.

Upon subsequent actuation of the copy start button 35 there is again started the first-face copying operation, which is terminated when the displayed number of completed copies is added with the number of newly obtained copies and becomes equal to the selected copy number, whereupon the second-face copying mode is enabled to light the lamp PL10 for a message requesting the original for the second face and to display the completed copy number and the selected copy number same as those displayed prior to the above-mentioned first-face copying operation for the second time.

Upon subsequent actuation of the copy start button, there is started the second-face copying operation, which is terminated when the displayed number of completed copies is added with the number of newly obtained copies and becomes equal to the selected copy number, whereby the entire copying operation is completed and the apparatus awaits the next double-side copying.

At the above-mentioned first-face copying mode of the second time and at the automatic shift to the second-face copying mode, the initially selected conditions with respect to the image magnification, density and copy outlet are automatically restored from the memory in the apparatus.

Also in case said deficient copies are no longer needed, the automatically selected first-face copying mode mentioned above can be cancelled by the actuation of a clear key. In this state any other copying mode can be freely selected as the intermediate tray 17 contains no copy sheet. In addition to the foregoing procedure, the deficiency in the number of copies resulting from the paper jamming in the course of second-face copying operation can be compensated in the following manner. After the paper jamming is resolved, the second-face copying operation is continued on all the copy sheets remaining in the intermediate tray 17 in the same manner as explained in the foregoing, and, upon completion thereof, the apparatus returns to the first-face copying mode, giving the message requesting the original for the first-face copying and giving the number of deficient copies as a newly selected copy number. In this case the copy modes initially selected for the first-face copying operation are automatically restored at the second first-face copying mode from the memory in the apparatus.

In case of subtraction type display, the number of deficient copies is direct-y indicated by the display of uncompleted copy number obtained at the end of second-face copying operation on all the copy sheets remaining in the intermediate tray, so that the apparatus simply returns to the first-face copying mode with the message requesting the original for the first-face copying but without change in the display, and restores the copying modes initially selected for the first-face copying.

Also in case the sorter 30 is used in combination with the double-side copying operation, the newly obtained copies for filling the deficiency are sorted in the sorter 30 starting from a bin succeeding to the last bin having received the completed copy before the interruption by the paper jamming.

(VI) If plural copy sheets are supplied simultaneously during the first-face copying operation, the number of copy sheets present in the intermediate tray becomes larger than the selected copy number. As the second-face copying cycle in the present embodiment is repeated until the copy sheets in the intermediate tray are exhausted, the completed copy number shown in the lower display unit becomes larger than the selected copy number displayed in the upper display unit.

Such second-face copying cycle applied on all the copy sheets present in the intermediate tray regardless of the copy number selected by the input keys ensures to obtain the copies having images on both faces in a preselected number, even in the presence of doubly supplied sheets in the first-face copying operation, though such doubled paper supply results in surplus copy sheets lacking the image on the first face.

(VII) In case of doubled paper supply during the course of the second-face copying mode, the completed copy number becomes less than the selected copy number. In the present embodiment, as will be apparent from the foregoing items (V) and (VI), the apparatus automatically returns to the first-face copying mode after the completion of the second-face copying operation if the number of copy sheets having images on both faces does not reach the copy number selected by the input keys.

In this manner the copies are always obtained exactly in the desired number, and the copying conditions with respect to the magnification, image density etc. at the initial first-face copying mode are automatically restored in the second first-face copying mode without repeated mode setting by the operator.

(VIII) In a rare case in which the power supply to the apparatus is interrupted by the power failure or by the error during the first- or second-face copying operation in the double-side copy mode, all the memories prior to such power interruption are erased and the apparatus assumes the standard mode upon restoration of the power supply. Thus, if the operator selects again the double-side copying mode while the intermediate tray 17 contains the copy sheets, the lamp PL11 is lighted to display a message requesting the removal of the copy sheets in the tray 17, and the copying operation is disabled until such removal is completed.

On the other hand, if the operator selects the single-side copy mode, the copying operation is enabled without such removal, as the presence of copy sheets in the intermediate tray 17 does not prohibit the single-side copying operation. In case said copy sheets in the tray 17 are those having the appropriate image on the first face thereof, it is possible to obtain copies with double-sided images by transferring said copy sheets to the first of second paper feed station manually and conducting the single-side copying operation on the second face of said copy sheets.

As explained in the foregoing the transfer to the first-face copying mode in the double-side copy mode is disabled in case the copy sheets are present in the intermediate tray.

(IX) The copier of the present embodiment is provided with a cut-in copying function, which is only enabled in the single-side copying mode but is disabled in the double-side copying mode.

Such cut-in or interruption copying can be made as single-side or double-side as the intermediate tray 17 is not used in the single-side copying operation. Upon actuation of an "interruption" button during the single-side copying operation, the copying operation is immediately interrupted and the copy mode returns automatically to the standard mode, but the copy modes prior to the interruption are all stored in the apparatus. The interruption copying can be conducted not only with the aforementioned standard mode but also with newly selected modes or copy number.

Upon completion of the interruption copying, the memorized copy modes are automatically restored to restart the interrupted copying operation upon actuation of the copy start button.

Now there will be given an explanation on the control circuit shown in FIGS. 3 and 4.

Figure 3:
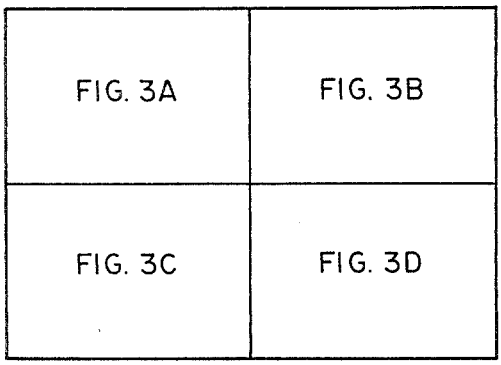
FIGS. 3, 3A, 3B, 3C, 3D, and 4 are diagrams of the control circuit for the copier shown in FIG. 1.
Figure 4:
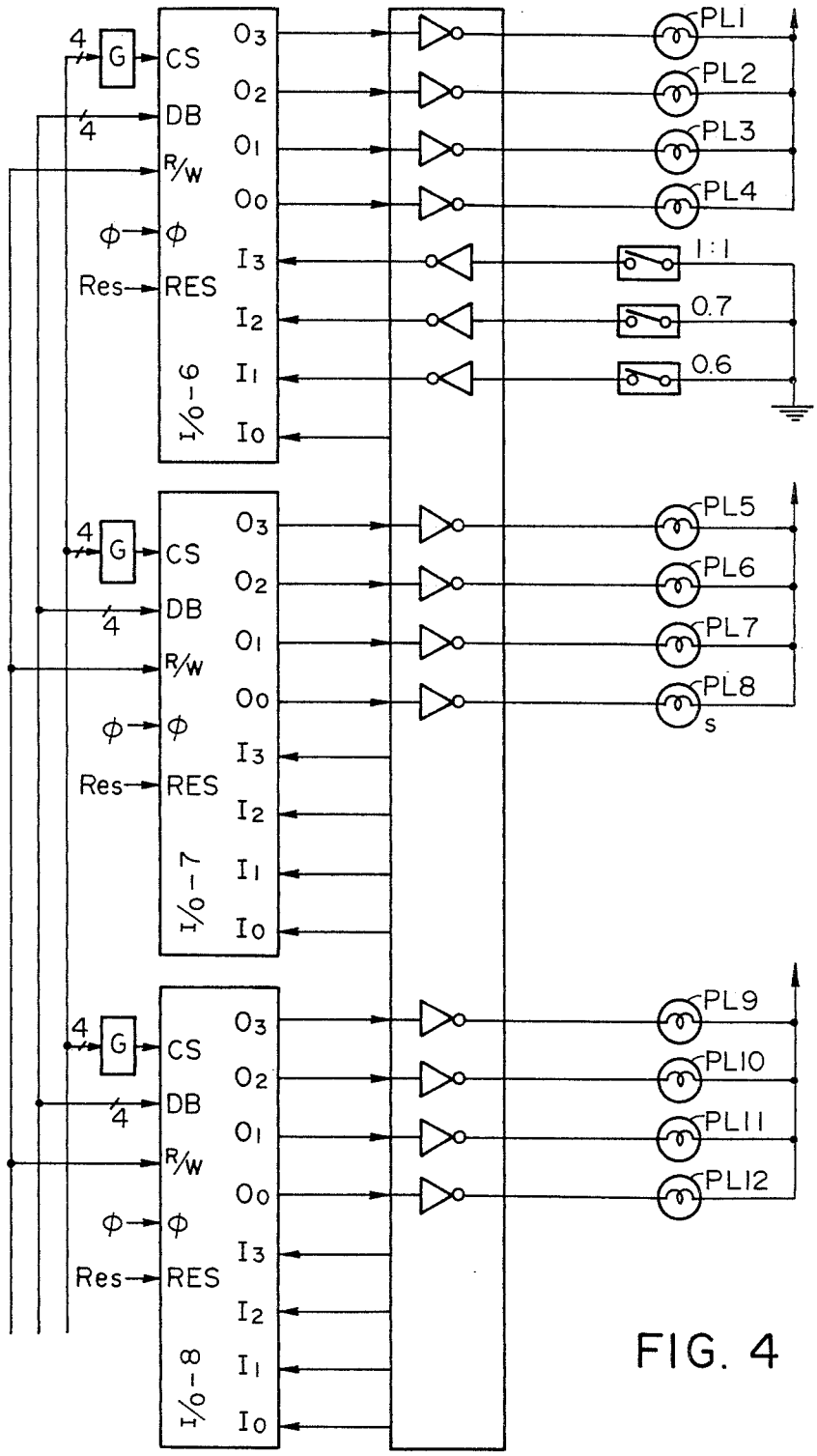
Figure 5B:
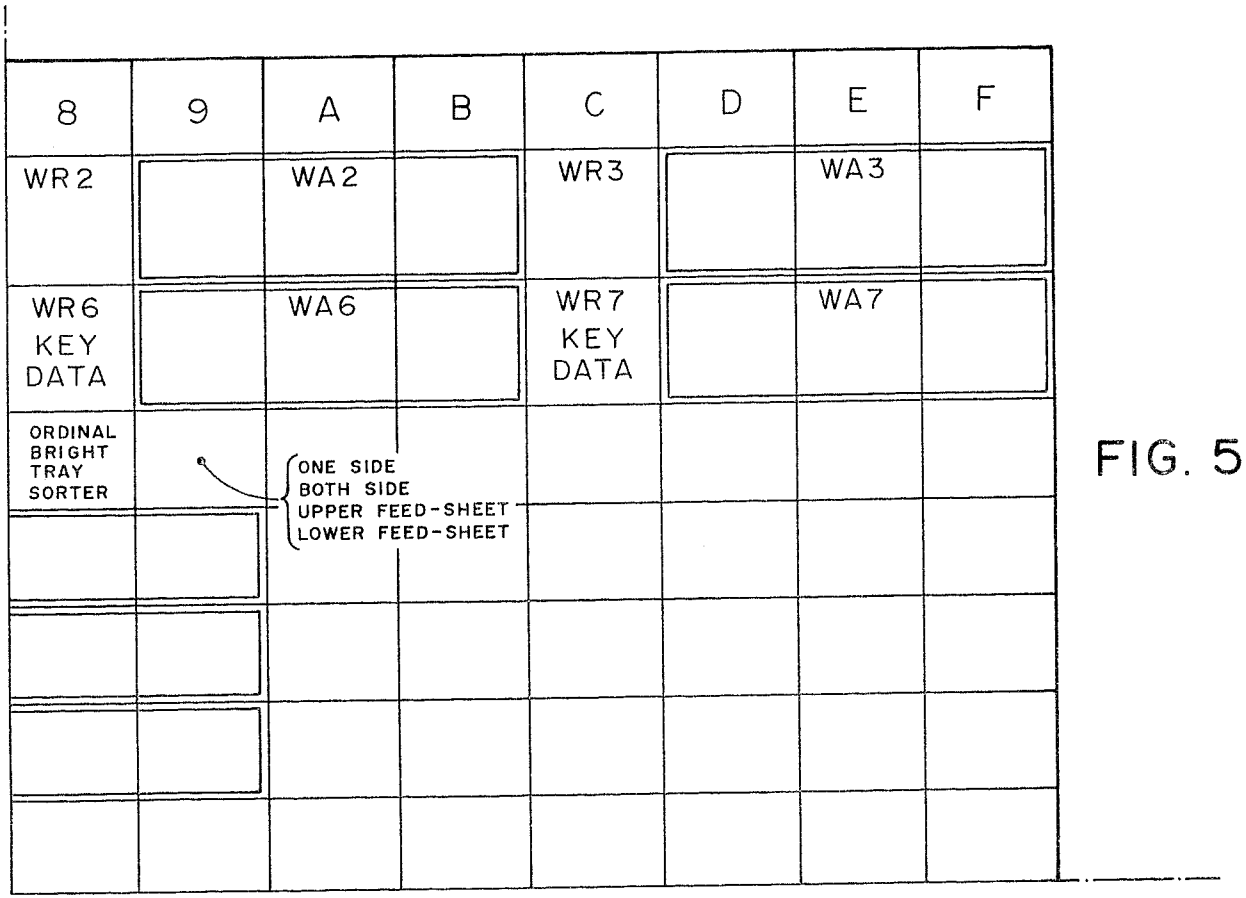
Figure 6A:
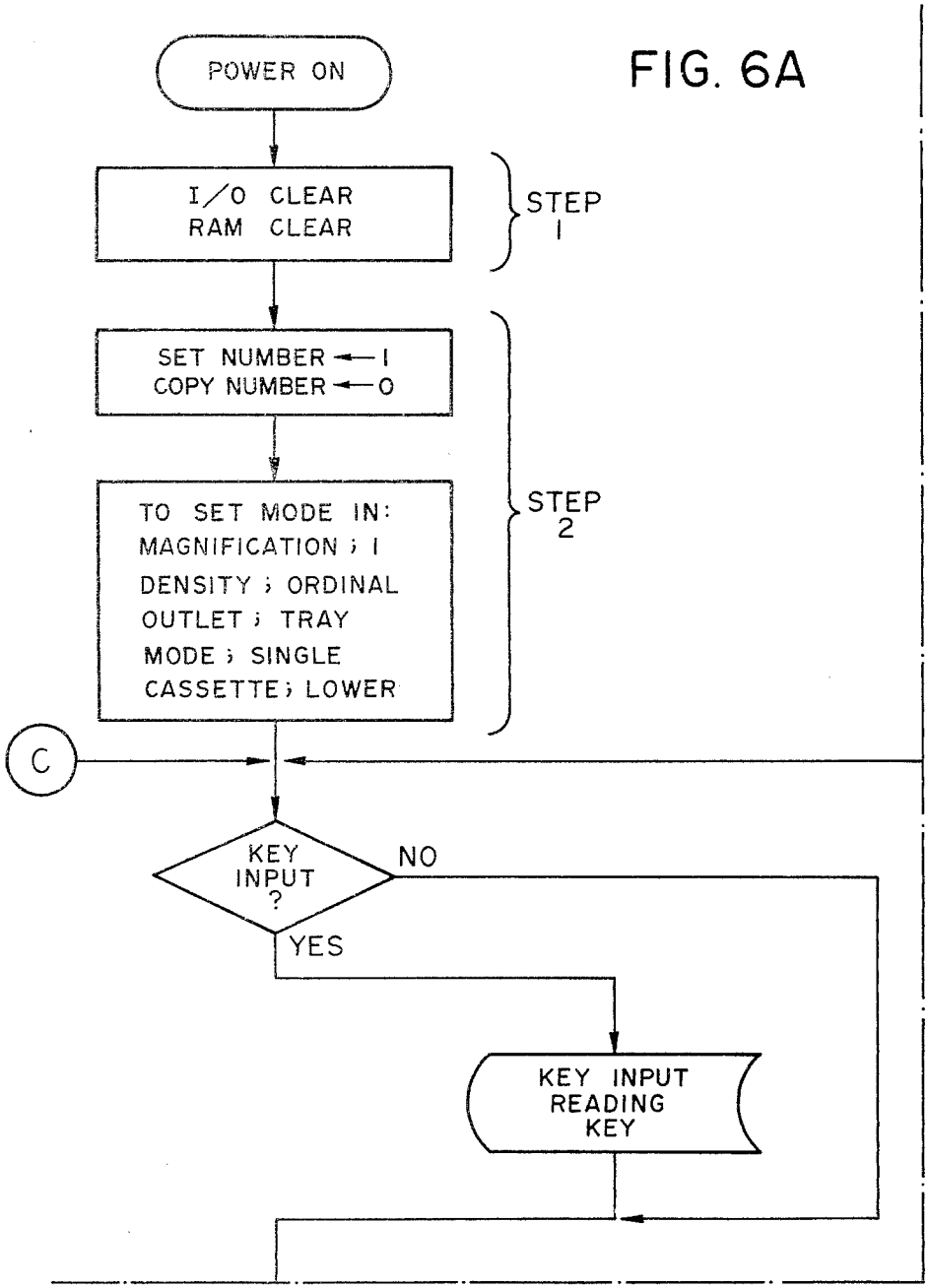
Figure 6B:
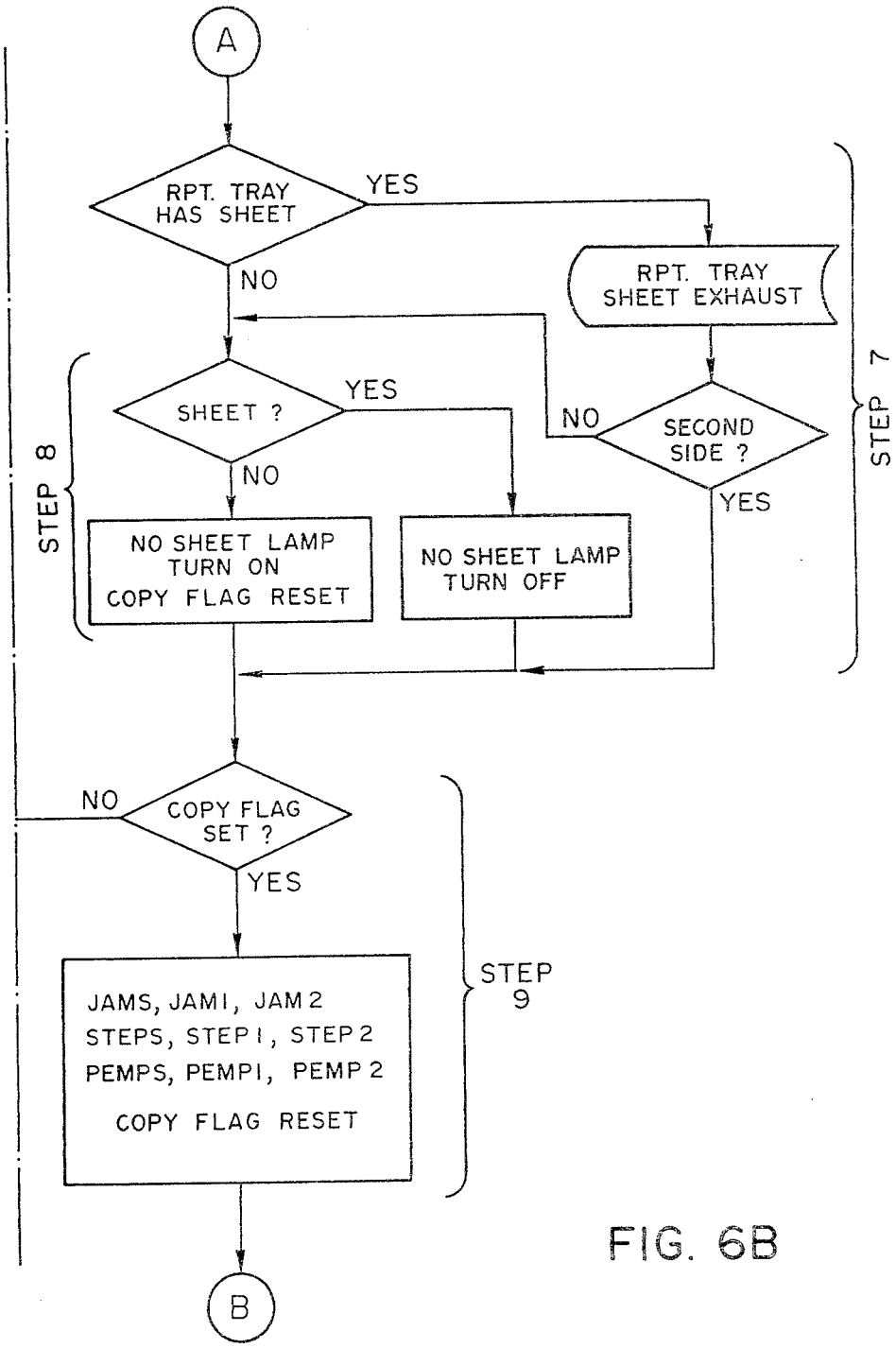
Figure 6C:
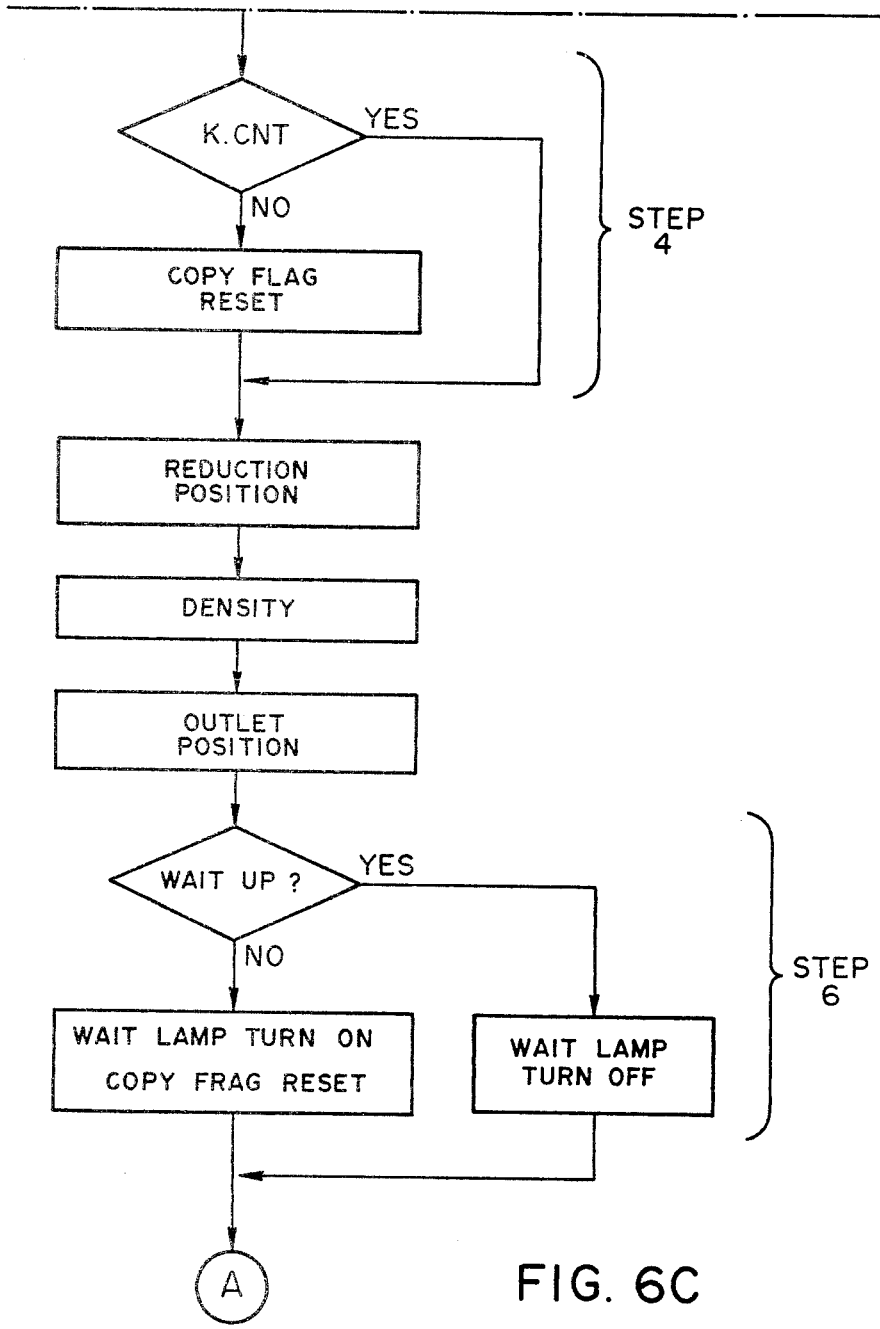
Figure 7A:
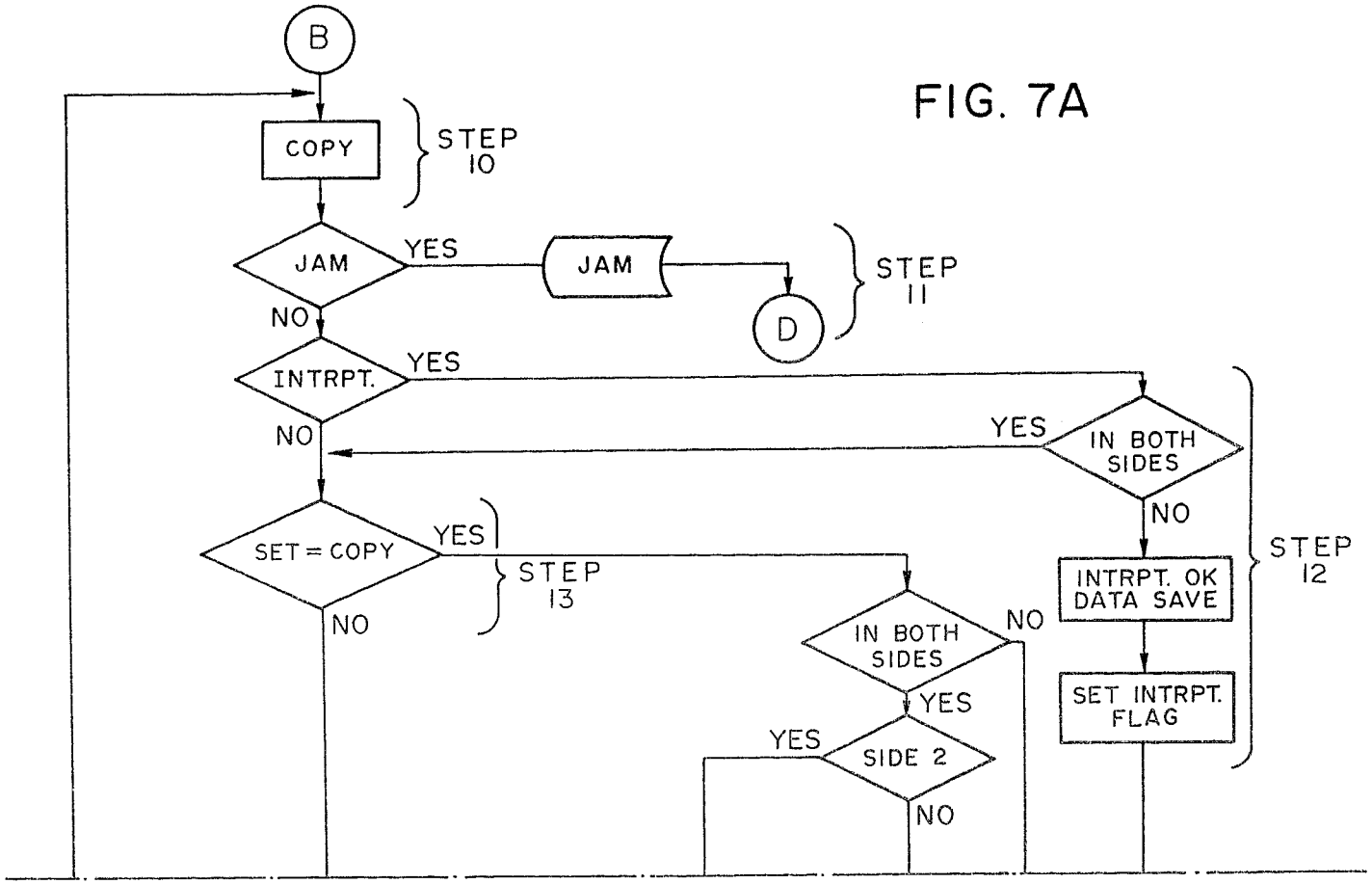
Figure 7B:
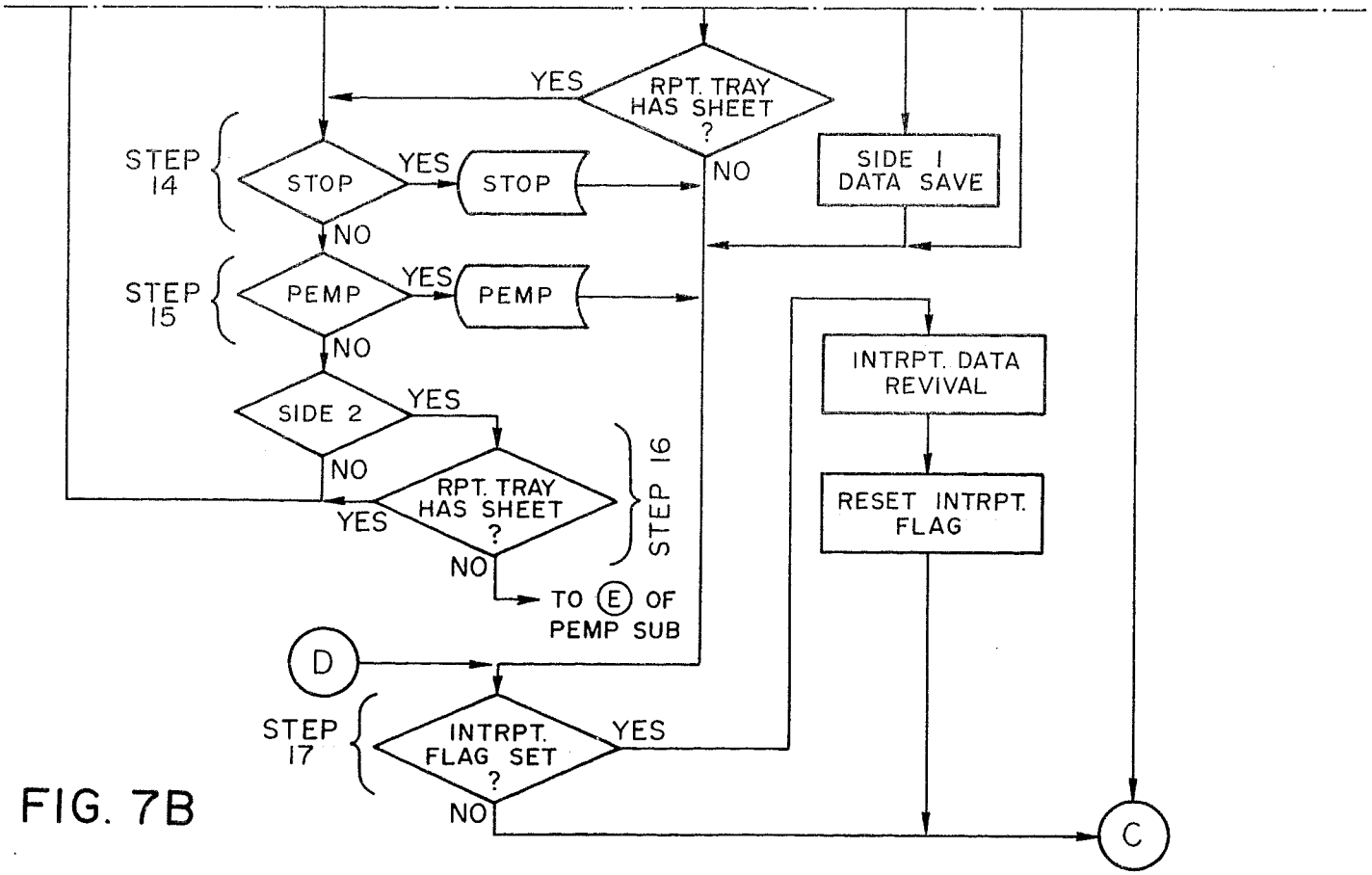
Figure 8A:
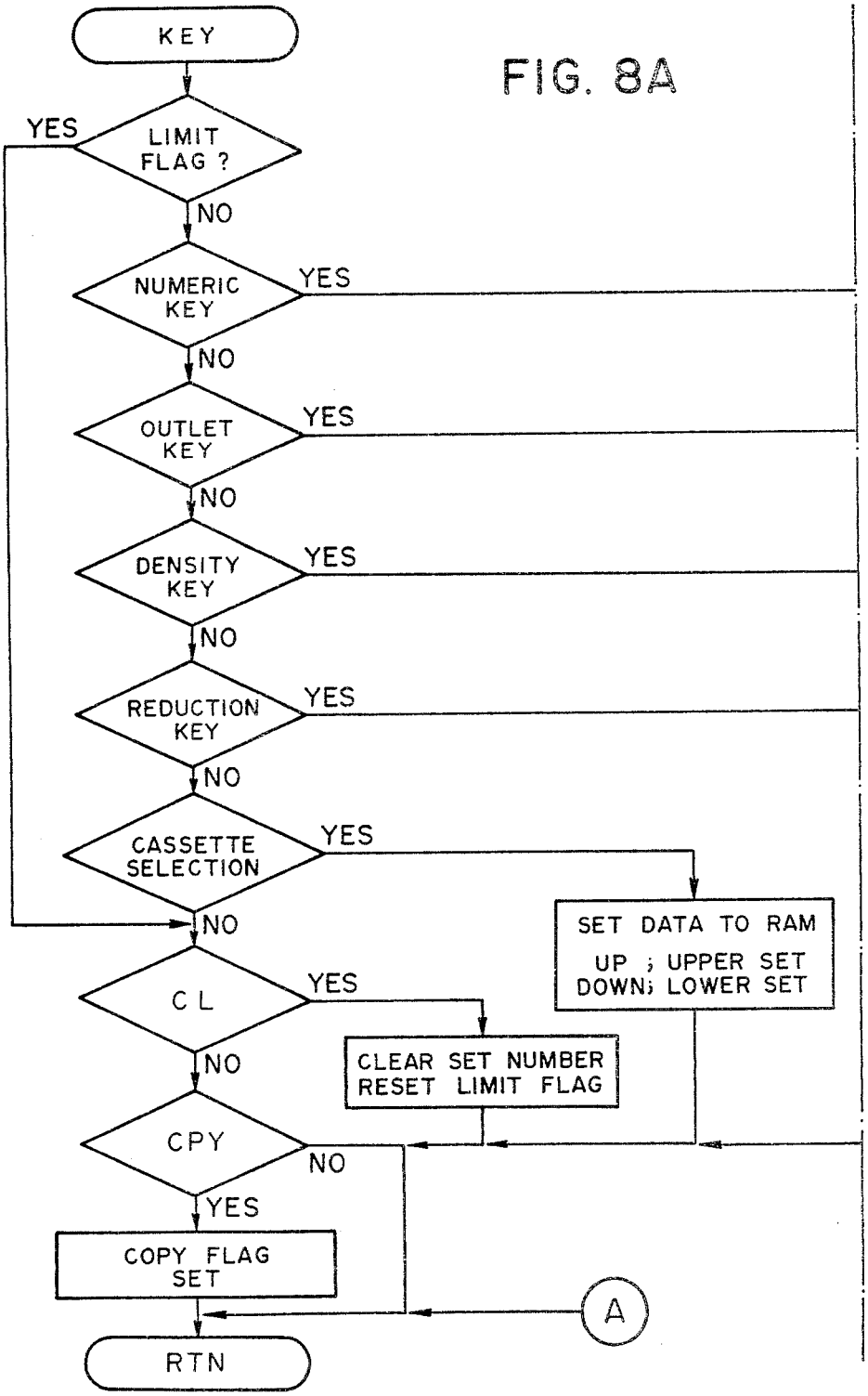
Figure 8B:
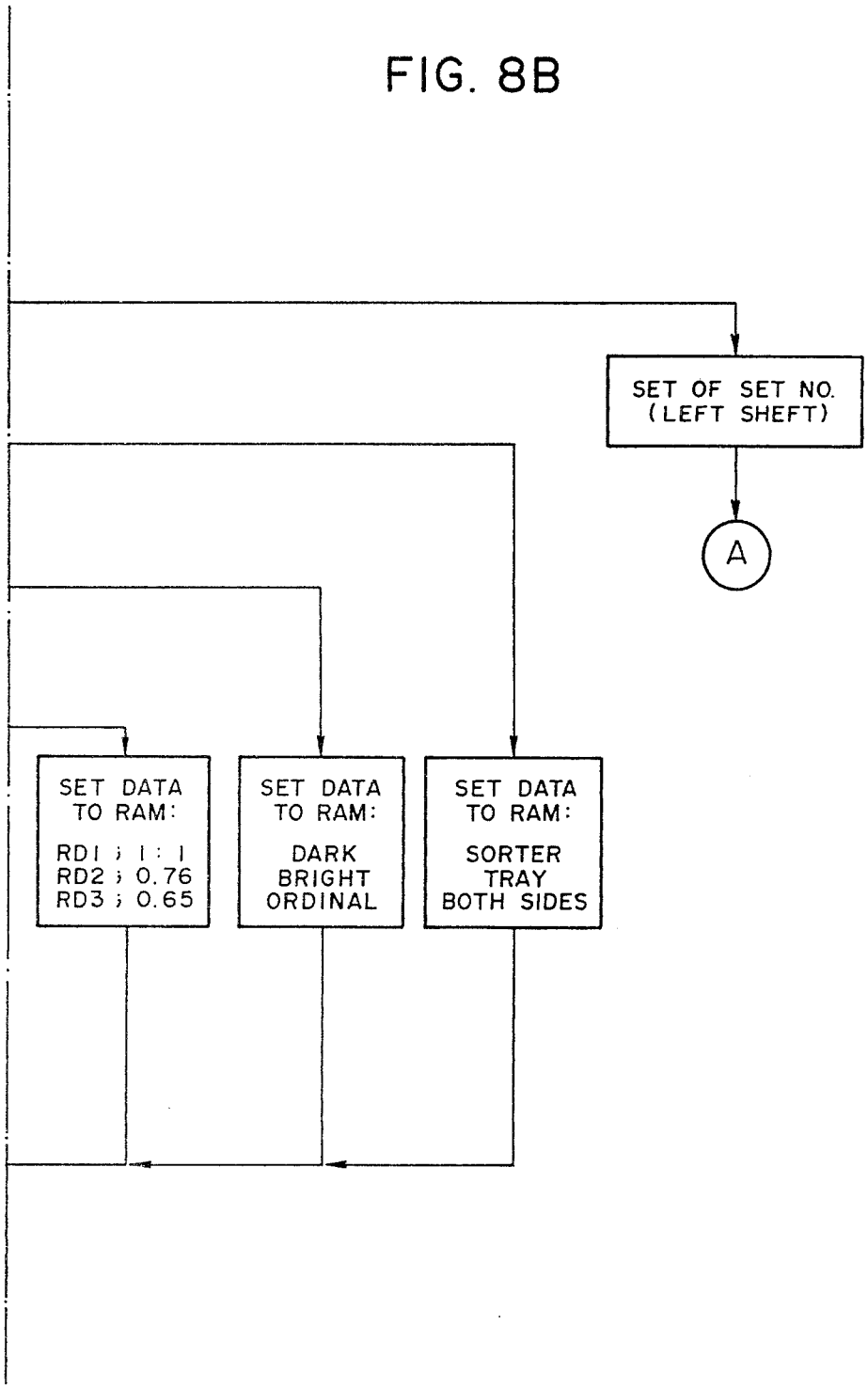
Figure 9:
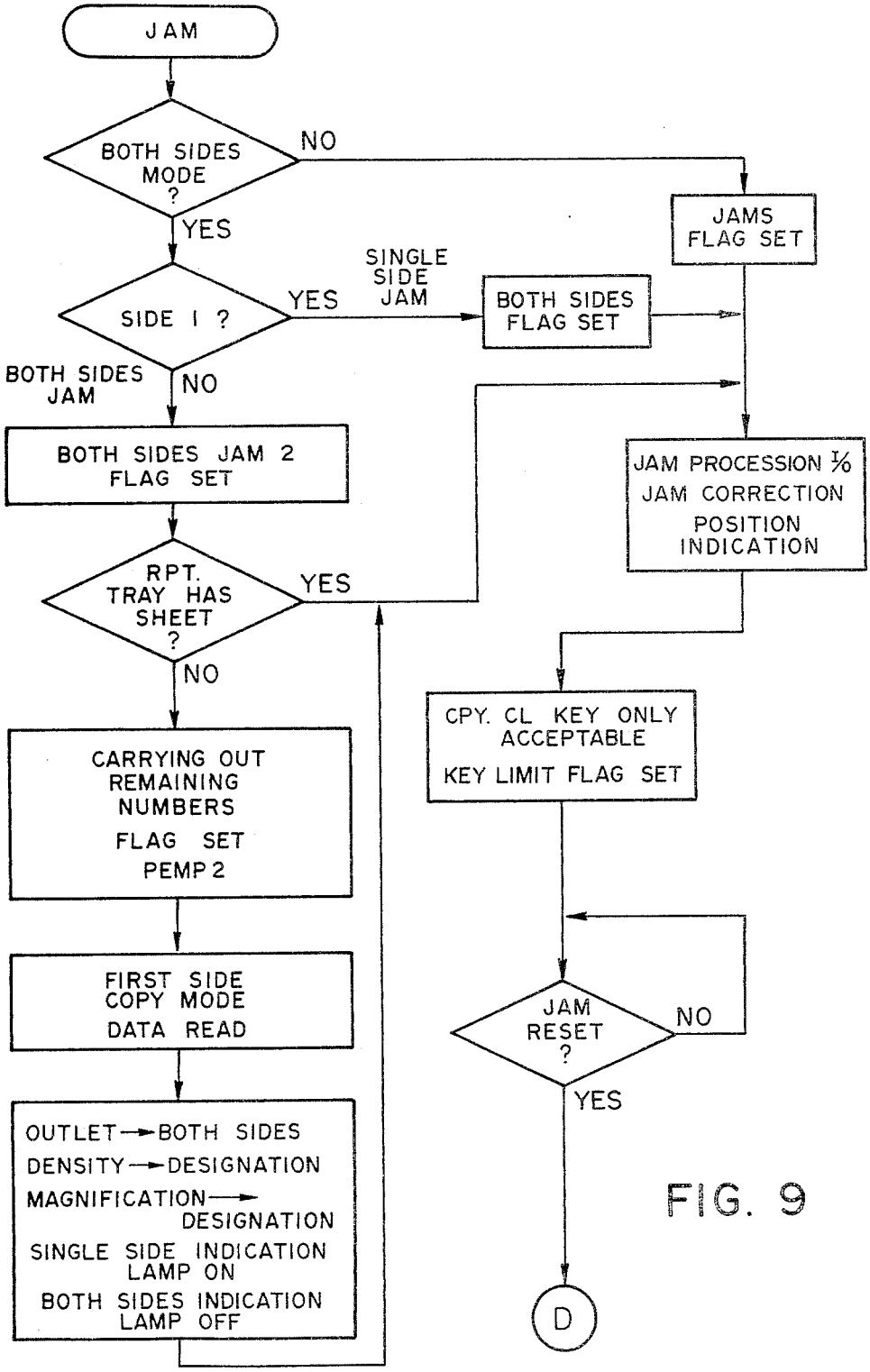

Referring to FIG. 3, a 4-bit parallel microprocessor CPU is provided with a random-access memory RAM of 256×4 bits, a program read-only memory ROM of 4K×8 bits, and 4-bit input/output device I/01-I/08, including an input/output device I/05 exclusively for the key switches and 7-segment display, for example composed of μpD757 supplied by NEC Company. Said input/output devices are connected to various loads through known drivers and input interfaces.

The sequence control of the apparatus is achieved by the program stored in said ROM.

Figure 7:
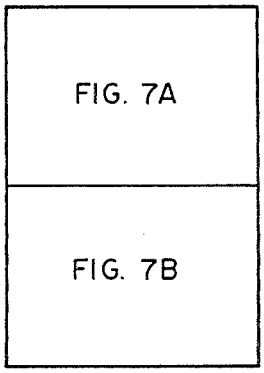
FIGS. 6, 6A, 6B, 6C, 7, 7A, 7B, 8, 8A, 8B, and 9–14 are control flow charts stored in the read-only memory shown in FIG. 3.
Figure 6:
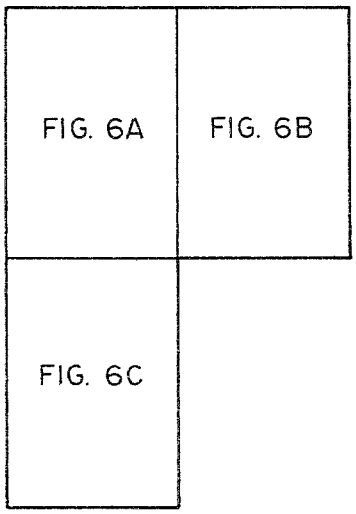
Figure 8:
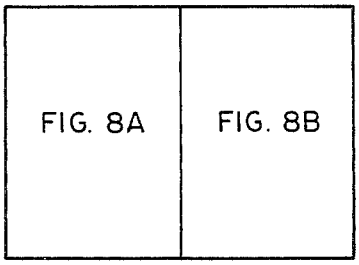
Figure 2A:
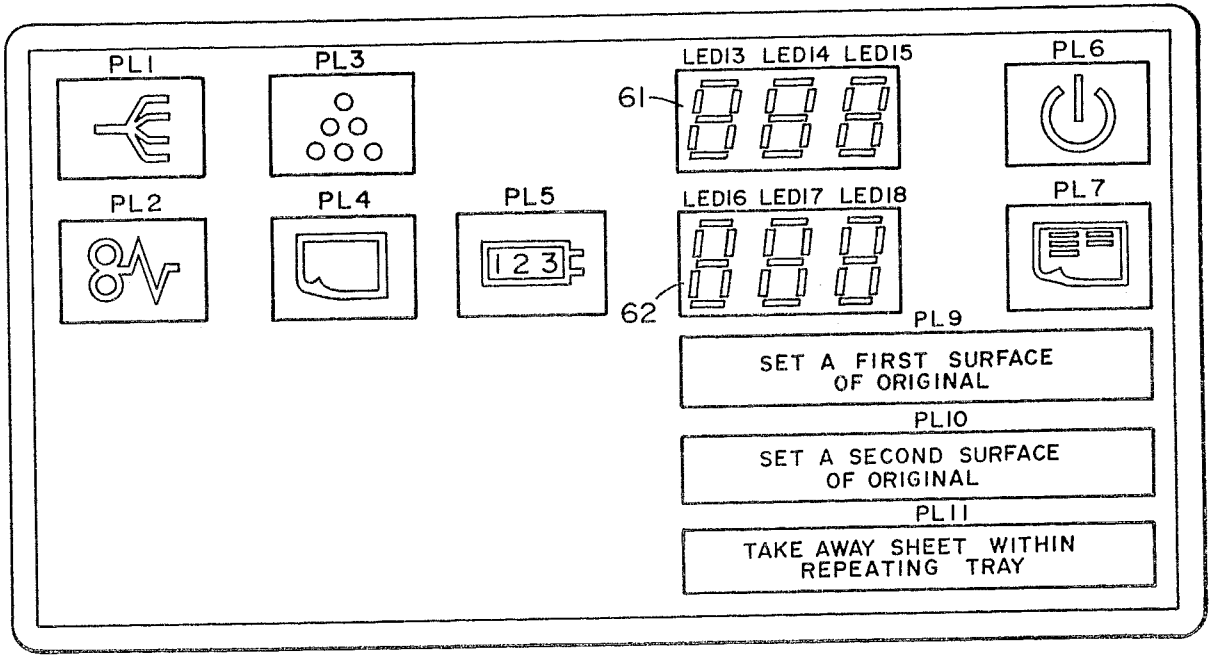
Figure 2B:
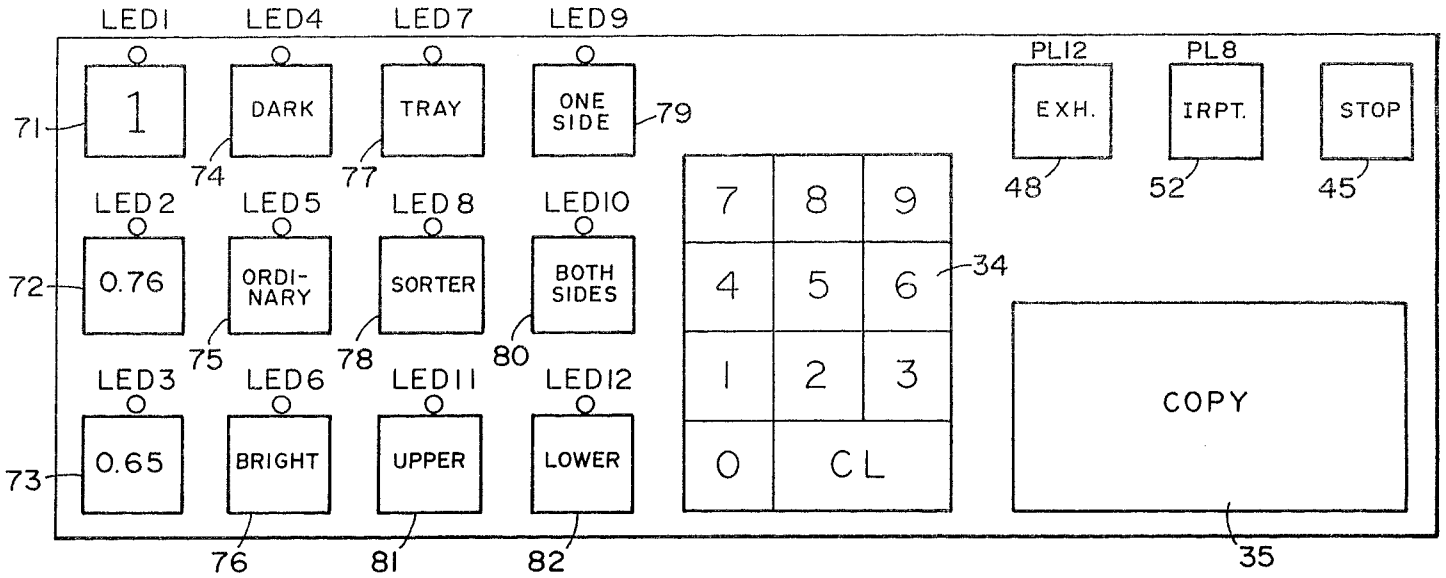
Figure 3A:
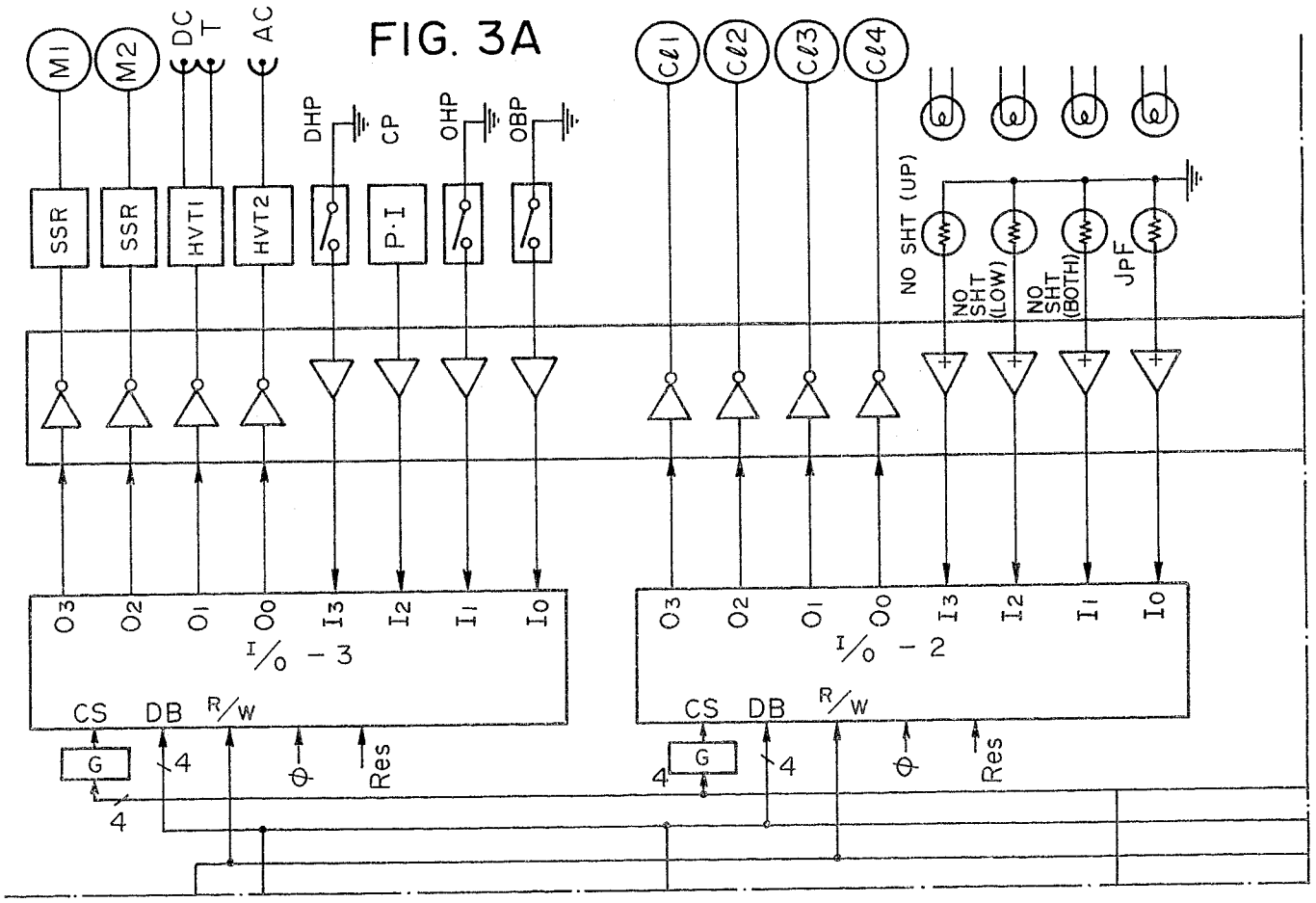
Figure 3B:
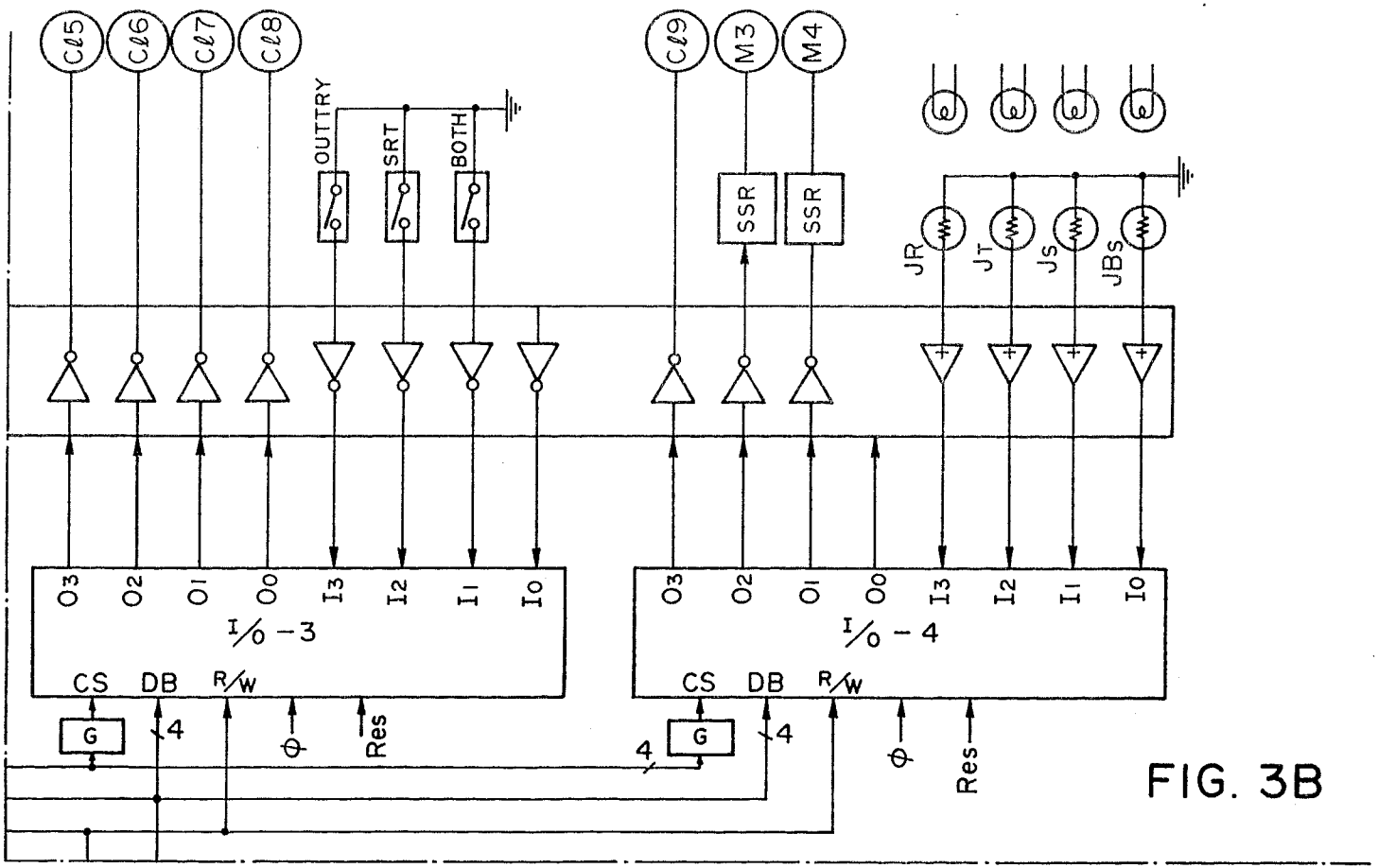
Figure 3C:
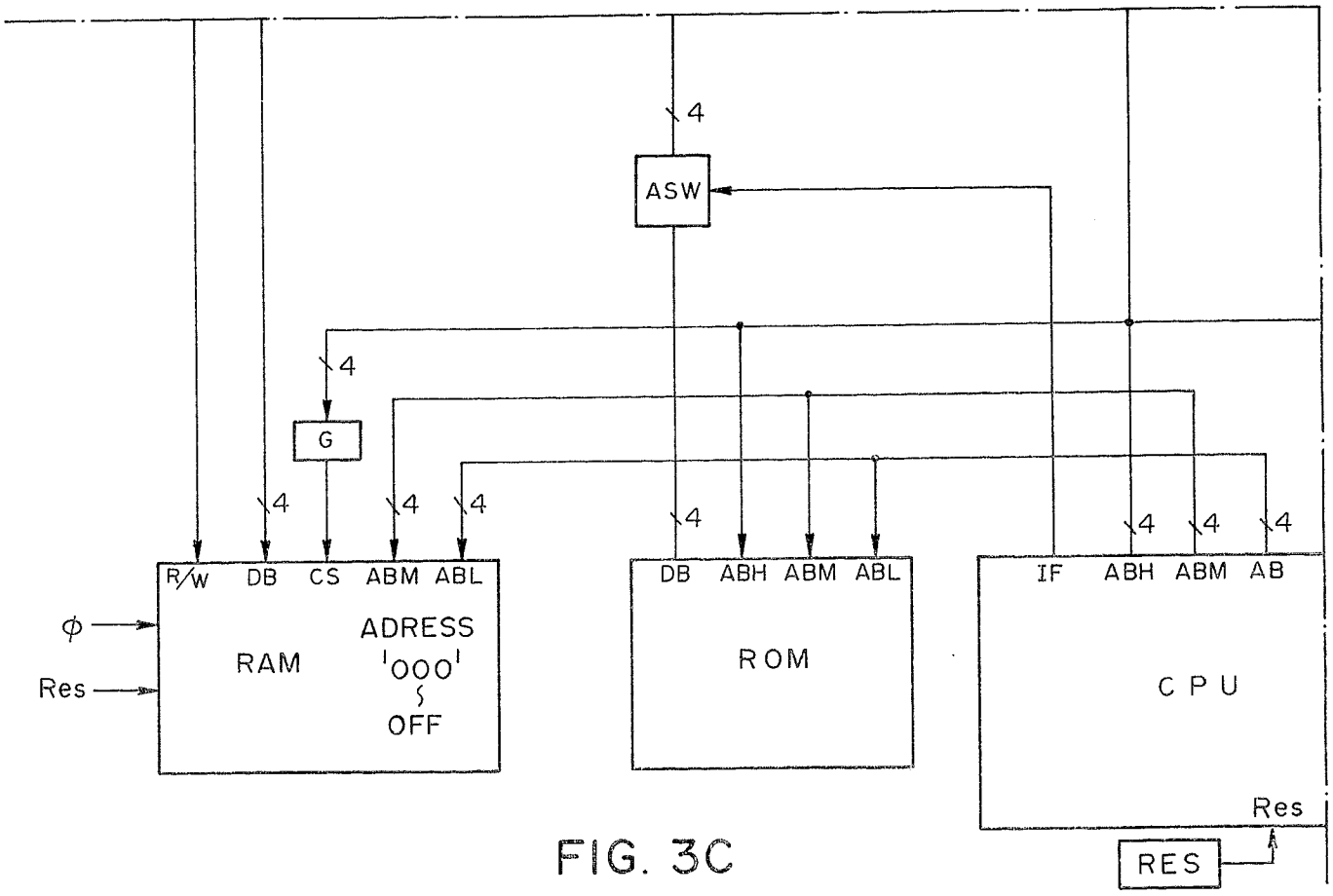
Figure 3D:
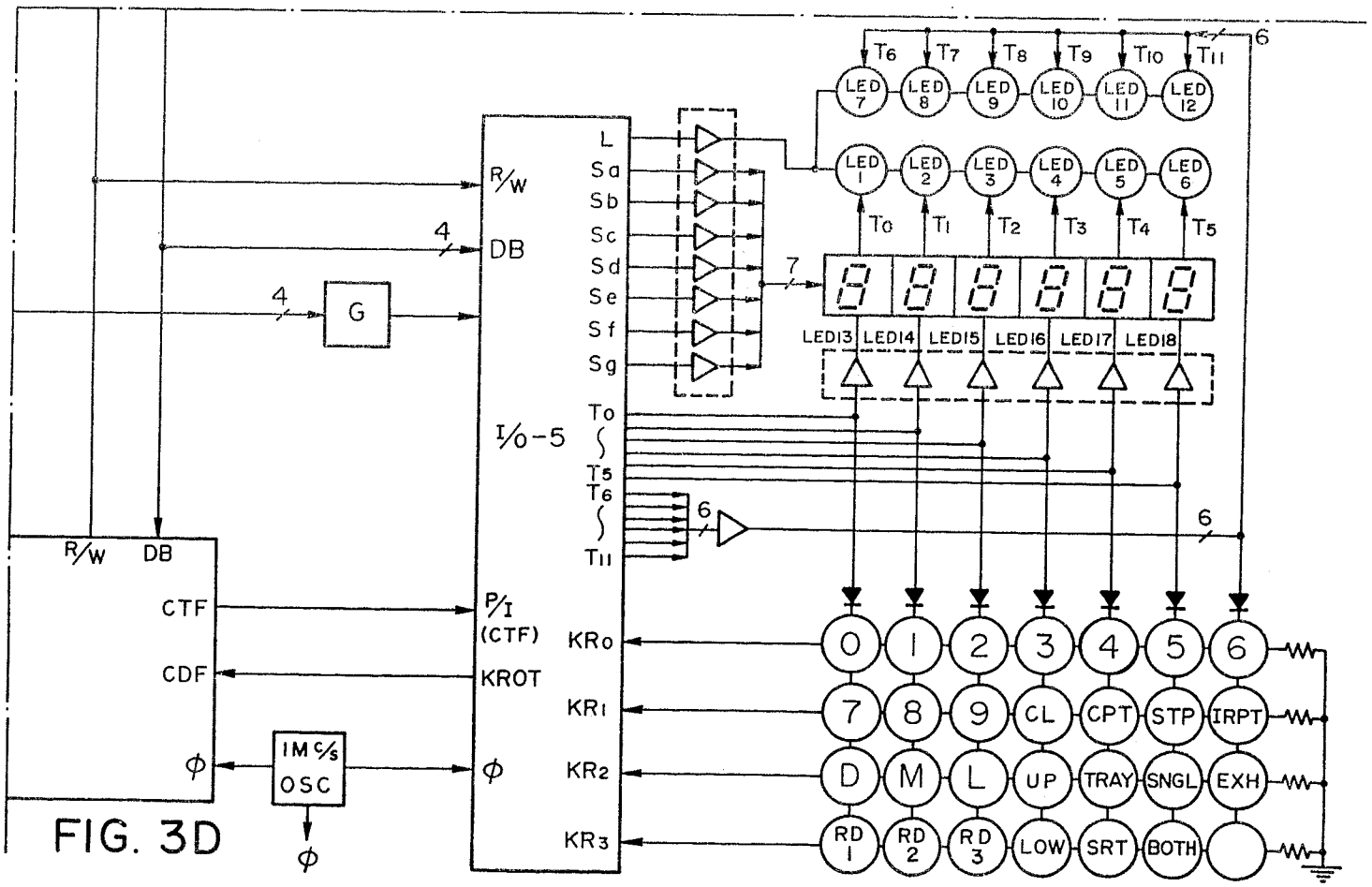

FIGS. 6 and 7 show the general flow of the program, while FIGS. 8 to 14 show the subroutines thereof.

Now referring to these flow charts, upon closing of unrepresented main switch, the CPU initiates function from the program address '000'.

At first in the step 1, the CPU clears all the RAM addresses "000"—"OFF", and also clears all the output ports, thus turning off all the process loads.

Figure 5:
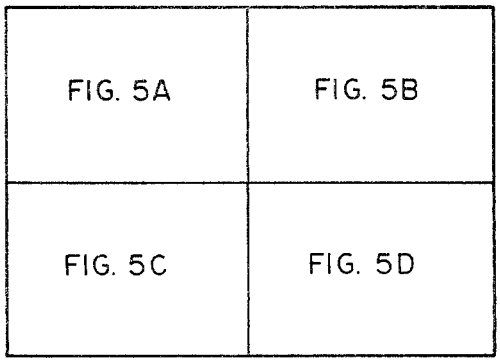

In the step 2, the CPU stores data CNT1=001 and CNT2=000 in the corresponding addresses, as shown in RAM map in FIG. 5, respectively for the selected copy number and the completed copy number. Then the data for the standard mode, i.e. "024"=0, "25"=2 (for lighting the original exchange lamp), "026"=0, "027"=8 (for indicating 1:1 magnification), "028"=A (for indicating normal density and tray lamp), and "029"=1 (for indicating lower cassette) are stored in the RAM as shown in FIG. 5, and the data stored in the RAM are released through the I/O devices.

The step 3 identifies the presence of key inputs, and executes the key subroutine to store the data in the RAM corresponding to the key inputs.

The step 4 identifies the presence or absence of key counter, and, in case of presence, proceeds to the next step but, in case of absence, resets the copy flag which may have been set by the eventual actuation of the copy start key in the step 3, thus preventing premature start of the copy sequence.

The step 5 executes, according to the content of RAM set in the steps 2 and 3, the reduction subroutine for adjusting the copier to the selected reduction ratio, the density subroutine for adjusting the image density and the outlet routine in the similar manner.

The step 6 identifies whether the fixing heater is already heated, and, if the fixing temperature is not reached, lights the waiting lamp and resets the copy flag for disabling the copy sequence. If the fixing temperature is already reached, the waiting lamp is extinguished and the program proceeds to the next step.

The step 7 identifies the presence of copy sheets in the intermediate tray and executes the paper eject subroutine from the intermediate tray (FIG. 14), which is effective only in the single-side copy mode.

The step 8 identifies the presence or absence of copy sheets in the selected cassette, and turns on the warning lamp indicating absence of paper and resets the copy flag in case of the absence.

The step 9 identifies the presence of copy flag, and, in case of presence, resets necessary flags and proceeds to the copy sequence. In case of absence of copy flag the program returns to the step 3 and repeats the "stand-by" routine of the steps 3 to 9.

The copy routine starts from the step 10.

The step 10 initiates the copy sequence, according to the settings made in the stand-by routine and in response to the actuation of the copy start button, by activating the main motor and repeating the steps of exposure, charging, development, paper feed etc. The following steps for the identification of paper jamming, interruption signal, completion of selected copy number, stop signal, no-paper signal etc. are once or plural times inserted in the repeated process loop for executing respective subroutine in case signals are identified, as will be explained in the following in relation to FIGS. 9, 10, 11 and 7.

Referring to FIG. 7, the program proceeds to the jam subroutine in case a jam is identified in the step 11. Also it proceeds, in response to the actuation of the interruption key, to the step 12 which however enables the interruption only in the single-side copying mode.

Upon enabling such interruption in the step 12, the data for copy modes, completed copy number and selected copy number for the interrupted copying operation are memorized by transfer from CNT1 to CNT4, CNT2 to CNT5 and RAM addresses "024"–"029" to "054"–"059", and an interruption start flag is set in the RAM address "079". Subsequently the program returns to the stand-by routine in which the key input is enabled for the selection of copy modes and of the copy number, thus enabling the copy operation in the interruption mode. In the absence of such interruption the program proceeds to the step 13.

The step 13 identifies the coincidence of the completed copy number with the selected copy number, and, in case of the first-face copying in the double-side copy mode, stores the data for said first-face copying in the RAM addresses "034"–"039" for the repeated first-face copying eventually needed in case of paper jamming in the course of second-face copying.

Also in the second-face copying in the double-side copy mode, the step 13 instructs the continuation of copying cycles until the copy sheets present in the intermediate tray are exhausted even after the completed copy number becomes equal to the selected copy number, since the number of copy sheets in said tray may be in excess of the selected copy number due to the supply of plural sheets at a time in the first-face copying.

Figure 10:
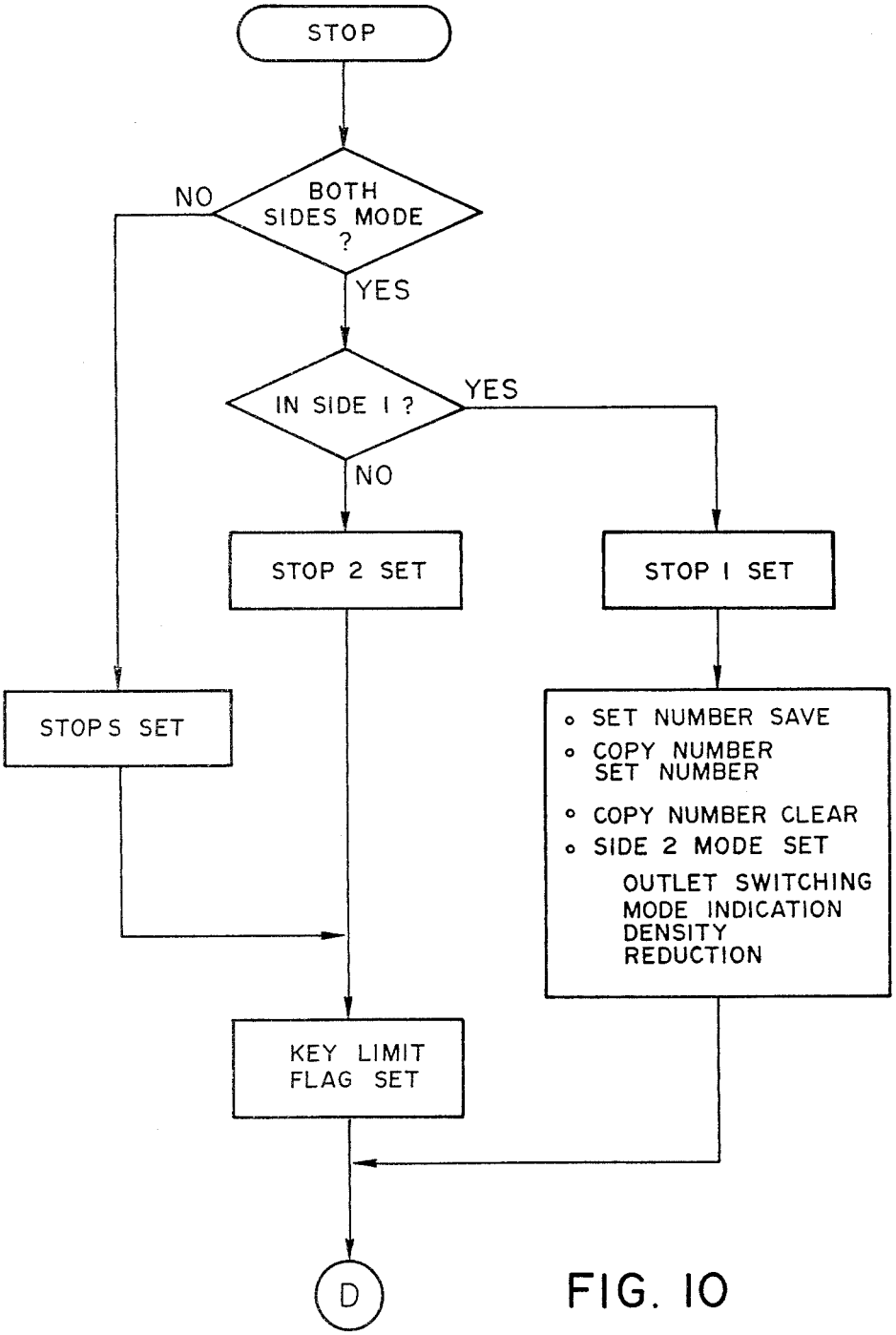

The step 14 identifies the actuation of the step key, and executes the STOP subroutine as will be explained later in relation to FIG. 10.

The step 15 identifies the presence or absence of copy sheet in the cassette, and, in case of absence, executes the PEMP subroutine as will be explained later in relation to FIG. 11.

Figure 11:
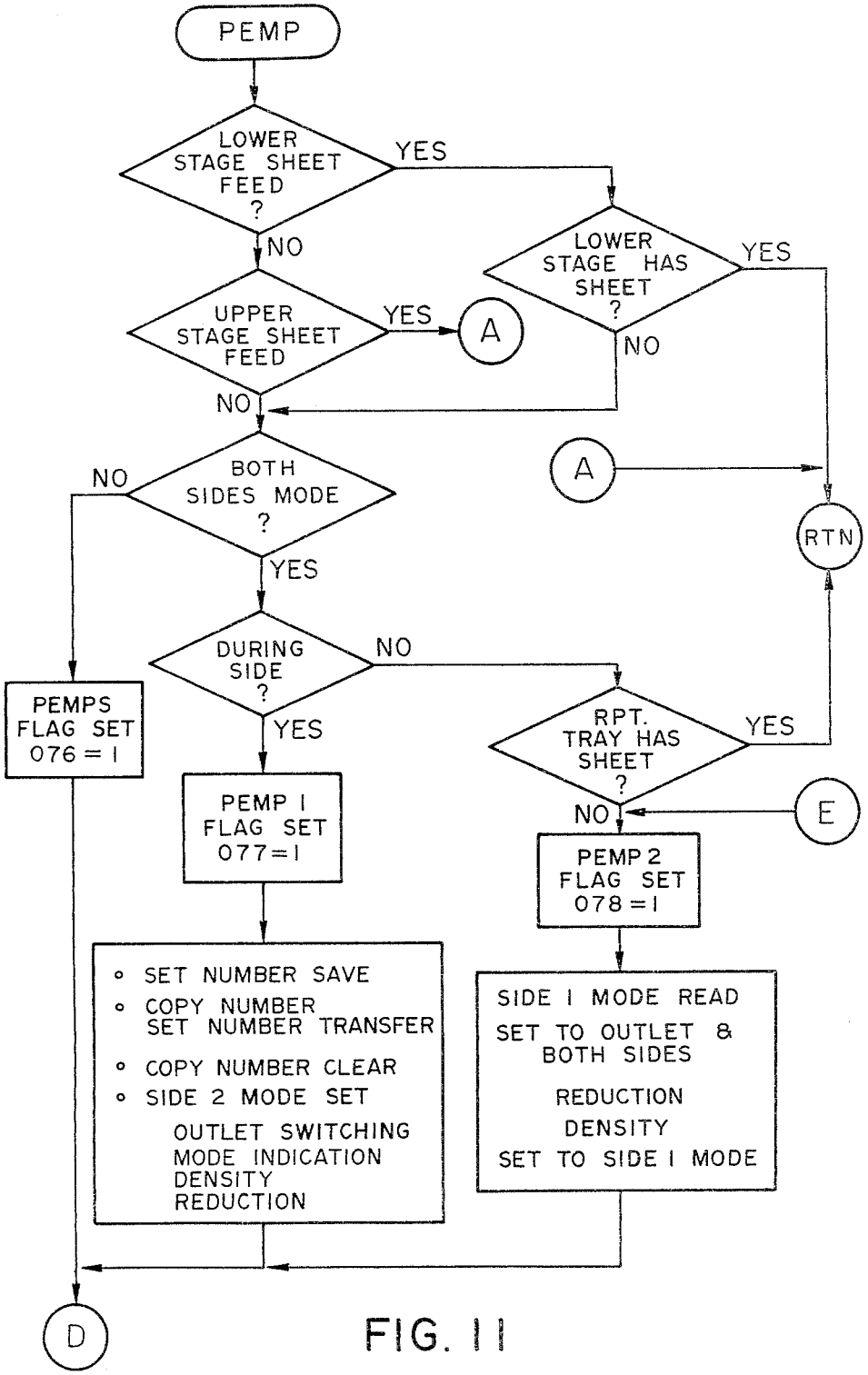
Figure 12:
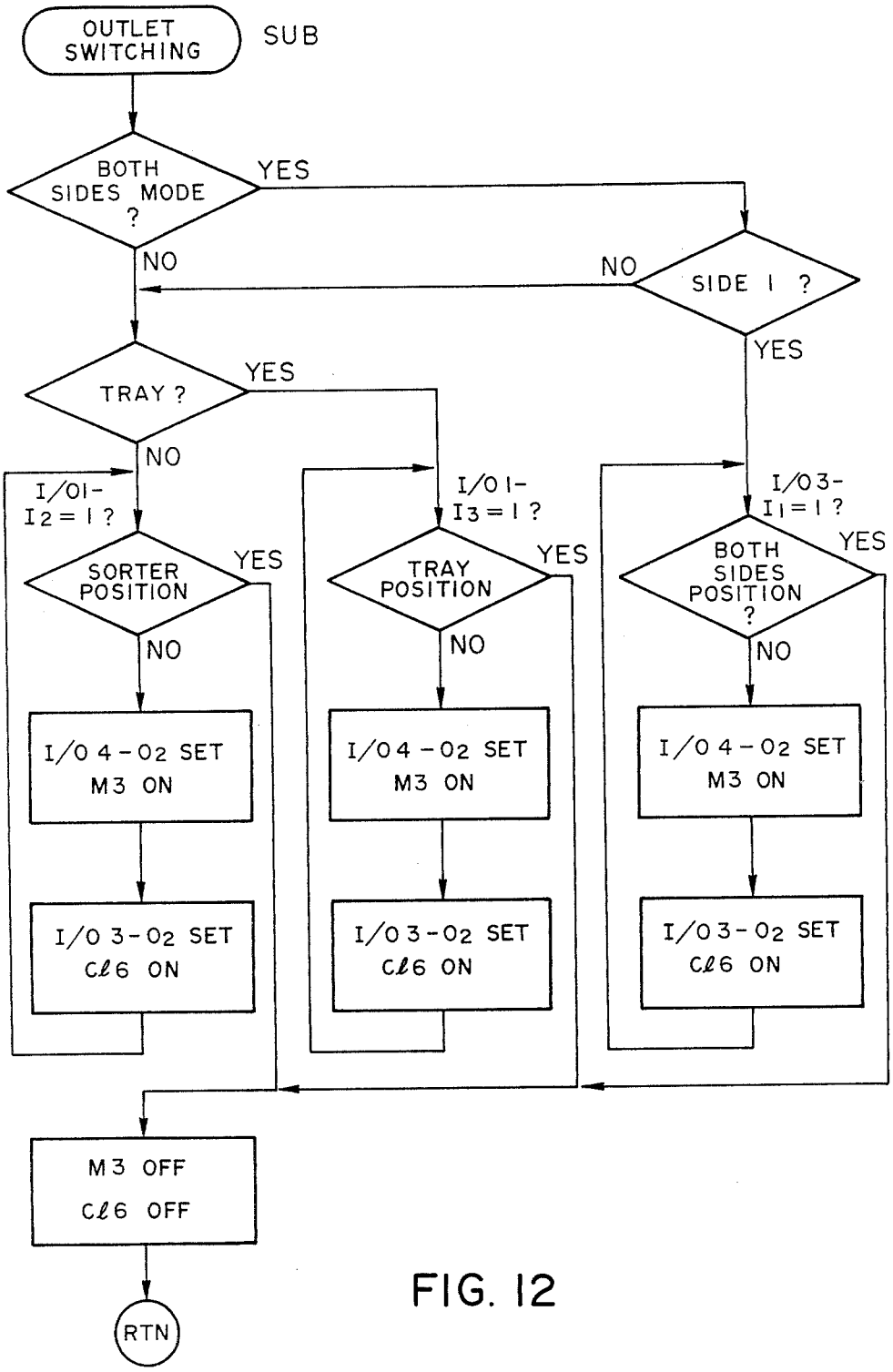
Figure 13:
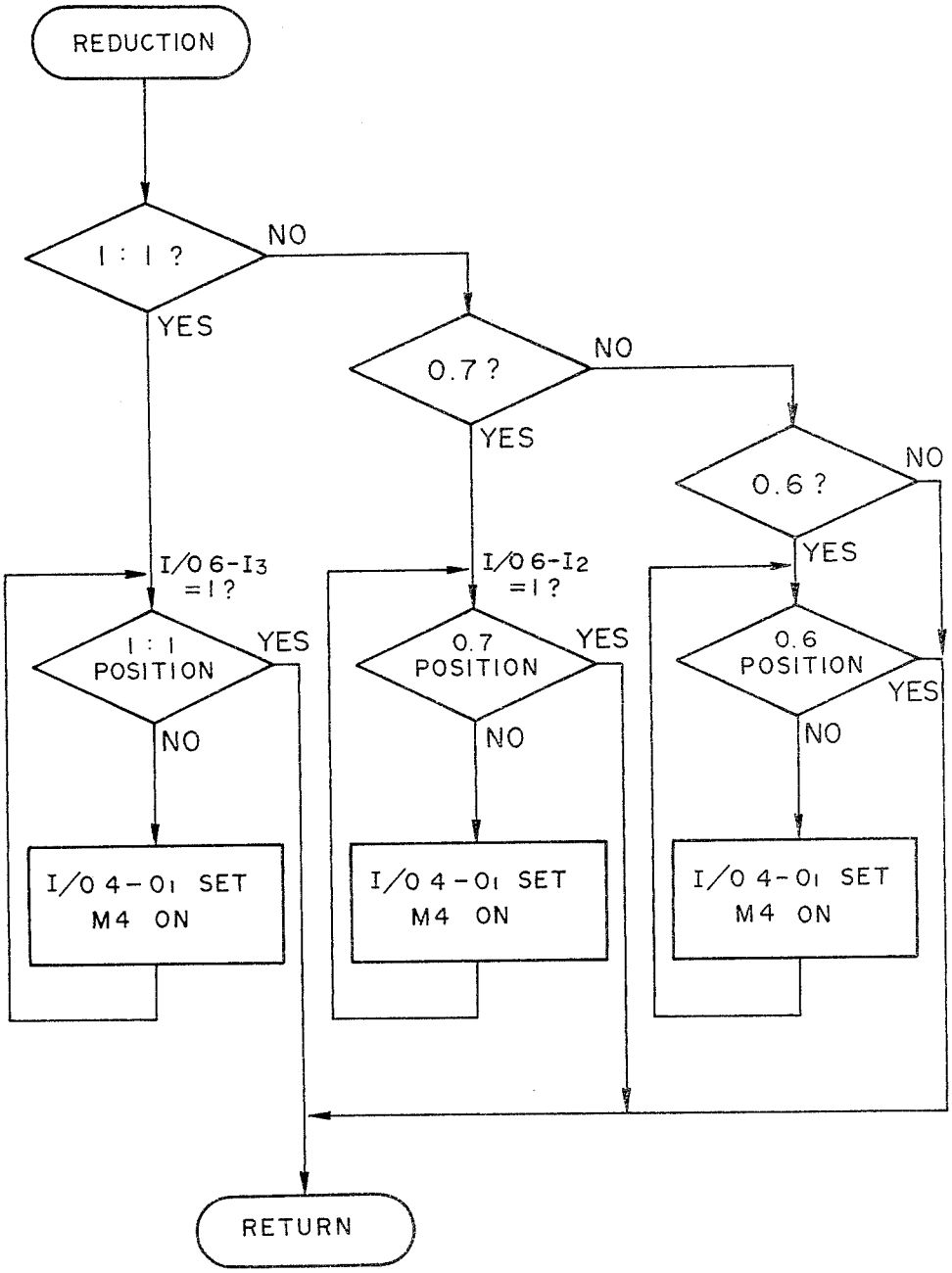
Figure 14:
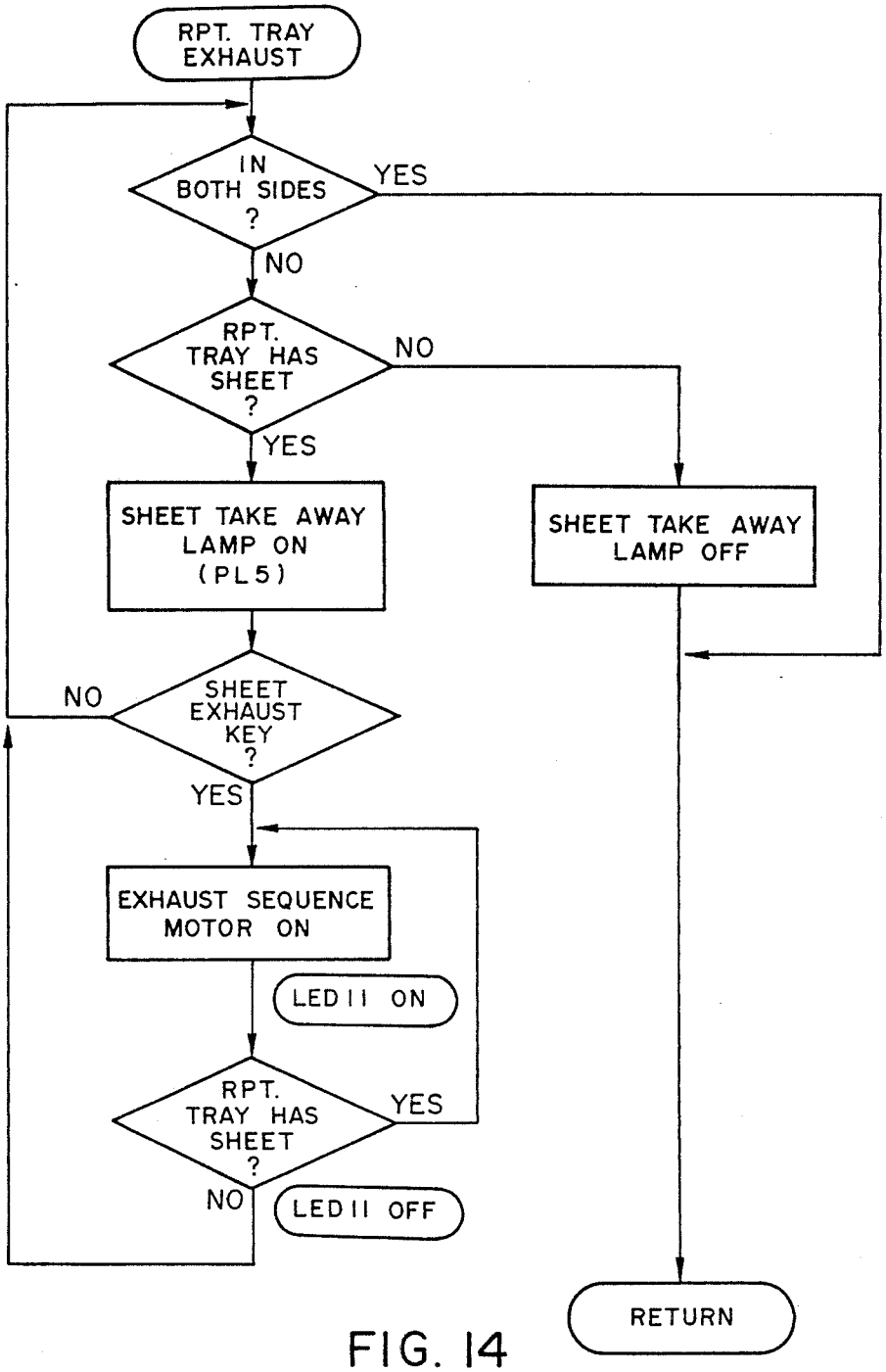

The step 16 identifies the absence of copy sheets in the intermediate tray during the second-face copying in the double-side copy mode, and causes the program to jump to the point E in FIG. 11, for setting the PEMP2 flag for preparing deficient copies in the first-face copying mode.

Now there will be given explanations on the various subroutines.

The KEY Subroutine stores the data in the working registers WR(b) and WR(M) (corresponding to the RAM addresses "018" and "01C") according to the following table, thus identifying the actuated keys and setting the corresponding RAM addresses. For example in response to the actuation of a key for image reduction by 0.7 times, a bit for a weight 4 in the RAM address "027" is set to "1".

In this subroutine the disabled keys are identified by the key limitation flag, in order to disable the mode keys other than the copy start key and the clear key CL for cancelling the already instructed modes in case of paper jamming, absence of copy sheets etc.

| Key | WR(6) | Key | WR(7) |
|---|---|---|---|
| 0 | 0 | D | 0 |
| 1 | 1 | M | 1 |
| 2 | 2 | L | 2 |
| 3 | 3 | Upper | 3 |
| 4 | 4 | Tray | 4 |
| 5 | 5 | Single-side | 5 |
| 6 | 6 | Paper eject | 6 |
| 7 | 7 | RD1 | 7 |
| 8 | 8 | RD2 | 8 |
| 9 | 9 | RD3 | 9 |
| CL | A | Lower | A |
| CPY | B | Sorter | B |
| STP | C | Double-side | C |
| IRPT | D | | |

The JAM Subroutine, in the single-side copy mode, sets the JAMS flag for resetting the I/O device for paper jamming, then transfers the data from CNT3 to CNT2 for indicating the number of effective copies, and causes the program to return to the stand-by routine after setting the key limitation flag.

A similar procedure is executed in case of jamming in the first-face copying in the double-side copy mode, except that a JAM1 flag is set instead of the JAMS flag.

In case of a jam in the second-face copying in the double-side copy mode, a JAM2 flag is set.

In case of absence of copy sheets in the intermediate tray in this state, the PEMP2 flag is set to restore the copy modes for the first-face copying in order to prepare additional copies for the deficiency, as the second-face copying cannot be continued due to the absence of copy sheets. After the jamming the program awaits the actuation of an unrepresented jam reset button.

The STOP Subroutine functions to set flags in response to the actuation of the stop key STP during the copying operation.

In case of actuation during the single-side copy mode, the STOPS flag and the key limitation flag are set and the program jumps to the point D in the stand-by routine in FIG. 7.

In case of actuation during the second-face copying in the double-side copy mode, the STOP2 flag and the key limitation flag are set and the program jumps to the point D in the stand-by routine in FIG. 7.

Also in case of actuation during the first-face copying in the double-side copy mode, the STOP1 flag is set, and the program is shifted to the second-face copying mode with the number of already completed copies taken as the selected copy number in order to prepare double-sided copies, while the initially selected copy number being memorized. In this case the key limitation flag is not set, and the key inputs are processed according to the STOP1 flag.

The PEMP Subroutine identifies the absence of copy sheets in the selected cassette in the copying operation. In case of absence of copy sheets, the subroutine identifies whether the single- or double-side copy mode is in action, and, in case of single-side copy mode, sets a PEMPS flag to cause the program to jump to the point D in the stand-by routine in FIG. 7. In case of the double-side copy mode, and in the first-face copying, the subroutine sets the PEMPS flag, then stores the data of the selected copy number, transfers the completed copy number to the selected copy number, clears the completed copy number and causes the program to jump to the point D in FIG. 7. In this manner, if the copy sheets are exhausted during the first-face copying, the deficient copies are to be made after the double-sided copies are completed on the already existing copy sheets.

In case of absence of copy sheets in the intermediate tray during the second-face copying, the PEMP2 flag is set to restore the first-face copying mode for preparing the first-face copying mode for the deficient copies.

The OUTLET SWITCH Subroutine identifies the double- or single-side copy mode, and, in case of the latter, identifies whether the tray or sorter is selected as the outlet. In case the sorter is selected, the subroutine identifies if the conveyor is positioned corresponding to the sorter, and, if not, activates a motor M3 and a clutch C16 until the conveyor is moved to a position corresponding to the sorter. A similar procedure is executed when the tray is selected.

In case of the first-face copying in the double-side copy mode, the subroutine directs the conveyor to the intermediate tray in a similar procedure, regardless whether the tray or sorter is selected as the final copy outlet.

In the second-face copying the subroutine directs the conveyor to the selected outlet.

The SIZE REDUCTION Subroutine functions according to whether the size instruction is 1:1, the 0.7 reduction or the 0.6 reduction. In case of 1:1 size instruction, the subroutine identifies if the optical system is positioned correspondingly, and, if not, activates a reduction motor M4 until the optical system is moved to a correct position. A similar procedure is executed for other size instructions.

The INTERMEDIATE TRAY EVACUATE Subroutine causes a display requesting the evacuation of the intermediate tray and enables such evacuation in response to a button actuation, in case of the presence of copy sheets in the intermediate tray except during the double-side copy mode.

More specifically, in case of the presence of copy sheets in the intermediate tray except during the double-side copy mode, the subroutine lights the lamp requesting the removal of copy sheets from said tray, and awaits the actuation of the paper eject key. In response to said key actuation, subroutine activates the main motor M1, fixing motor $M3_1$, double-side paper feed clutch and registering clutch, thus ejecting copy sheets from the intermediate tray to the tray through the paper transport path, until the copy sheets in the intermediate tray are exhausted.

As explained detailedly in the foregoing, the present invention provides a double-side image forming apparatus allowing easier use. Naturally the present invention is not limited to the foregoing embodiment but includes any and all modifications and variations within the scope and spirit of the present invention.

What we claim is:

1. A double-side image forming apparatus, comprising:

image forming means for effecting image formation on both faces of sheet-shaped image bearing members;

means for storing said image bearing members having an image on a first face thereof;

means for selecting the number of image bearing members to be subjected to said image formation; and control means for effecting image formation by said image forming means in a first mode on the first face of each of said selected image bearing members, then temporarily storing said selected image bearing members in said storage means, and for effecting image formation by said image forming means in a second mode on the second face of each of said selected image bearing members;

wherein said control means is adapted, in response to a particular signal received during said first mode and before the number of image formations reaches said selected number, to effect image formation in the second mode on the image bearing members stored in said storage means.

2. A double-side image forming apparatus according to the claim 1, wherein said control means automatically enables image formations in said first mode after the completion of image formation in said second mode.

3. A double-side image forming apparatus according to the claim 1, wherein the number of image bearing members stored in said storage means at the receipt of said particular signal in the course of image formation in the first mode is taken as the selected number of image formations in the second mode.

4. A double-side image forming apparatus according to the claim 2, wherein said particular signal indicates the absence of said image bearing members in a supply station therefor.

5. A double-side image forming apparatus according to the claim 4, capable of effecting image formations corresponding to the difference between said selected number and the number of actually effected image formations, after the completion of image formations in the second mode in response to the replenishment of image bearing members in said supply station therefor.

6. A double-side image forming apparatus, comprising:

image forming means for effecting image formation on sheet-shaped image bearing members;

means for selecting the number of image bearing members to be subjected to said image formation;

means for selectively assigning a copying mode in which an image formation is performed on the image bearing members, said mode assigning means being capable of assigning different copying modes according to whether image formation is performed on a first-face or a second-face of the image bearing members;

means for storing said image bearing members having an image on a first face thereof; and control means for effecting image formation by said image forming means in a first mode assigned by said assigning means on the first face of each of said selected image bearing members, then temporarily storing said selected image bearing members in said storage means, and for effecting image formation by said image forming means in a second mode assigned by said assigning means on the second face of each of said selected image bearing members;

wherein said control means is adapted, in response to reception of a particular signal received during the image formation in said second made, to interrupt the image formation, to effect image formation in said second mode on the image bearing members stored in said storage means after the image formation is restarted, and to enable the image formation in said first mode thereafter.

7. A double-side image forming apparatus according to the claim 6, wherein said control means is adapted to retain said selected number and the number of already effected image formations at the receipt of said particular signal.

8. A double-side image forming apparatus according to the claim 6, wherein said particular signal indicates a jamming of said image bearing member.

9. A double-side image forming apparatus according to the claim 6, wherein said control means is adapted, after completion of the image formations on the image bearing members stored in said storage means, to enable image formation in the first mode for filling any deficiency caused by said jamming.

10. A double-side image forming apparatus according to the claim 9, wherein said control means is adapted, in said first mode, to effect the image formations only for such deficiency caused by said jamming.

11. A double-side image forming apparatus according to claim 6, wherein said mode assigning means assigns a multiplication of copy size.

12. A double-side image forming apparatus according to claim 6, wherein said mode assigning means assigns a density value.

13. A double-side image forming apparatus according to claim 6, further comprising supply sources of image bearing members, wherein said mode assigning means assigns said supply sources.

14. A double-side image forming apparatus according to claim 6, wherein said control means stores the first or second mode assigned by said mode assigning means and recovers automatically to the stored first mode after interruption during the second mode.

15. A double-side image forming apparatus, comprising:

image forming means for effecting image formation on sheet-shaped image bearing members;

means for selecting the number of image bearing members to be subjected to said image formation;

means for selectively assigning a copying mode when an image formation is performed on the image bearing members, said mode assigning means being capable of assigning different copying modes according to whether image formation is performed on a first-face or a second-face of the image bearing members;

means for storing said image bearing members having an image on a first face thereof; and control means for effecting image formation by said image forming means in a first mode assigned by said assigning means on the first face of each of said selected image bearing members, then temporarily storing said selected image bearing members in said storage means, and for effecting image formation by said image forming means in a second mode assigned by said assigning means on the second face of each of said selected image bearing members;

wherein said control means stores the first mode assigned by said mode assigning means and recovers automatically to said stored first mode at the time of restarting of image formation on the first-face of image bearing members.

16. A double-side image forming apparatus according to claim 15, wherein said restarting of image formation is first-face processing fills the deficiency caused by a jamming.

17. A double-side image forming apparatus, comprising:

image forming means for effecting image formation on sheet-shaped image bearing members;

means for selecting the number of image bearing members to be subjected to said image formation;

means for selectively assigning a copying mode in which an image formation is performed on the image bearing members, said mode assigning means being capable of assigning different copying modes according to whether image formation is performed on a first-face or a second-face of the image bearing members;

means for storing said image bearing members having an image on a first face thereof; and control means for effecting image formation by said image forming means in a first mode assigned by said assigning means on the first face of each of said selected image bearing members, then temporarily storing said selected image bearing members in said storage means, and for effecting image formation by said image forming means in a second mode assigned by said assigning means on the second face of each of said selected image bearing members;

wherein said control means is adapted, in response to reception of a particular signal received during the image formation in said second mode, to interrupt the image formation and to enable the image formation on the first-face to restart in said assigned first mode.

* * * * *

UNITED STATES PATENT AND TRADEMARK OFFICE

CERTIFICATE OF CORRECTION

PATENT NO. : 4,437,756

DATED : March 20, 1984

INVENTOR(S) : KAZUO KAWAKUBO, ET AL.

It is certified that error appears in the above-identified patent and that said Letters Patent is hereby corrected as shown below:

COLUMN 1

Line 17, after "twice" insert --the--.

Line 53, after "process" insert --, the--.

COLUMN 2

Line 17, "being featured in" should read --this feature occurring in the--.

Line 42, delete "of".

COLUMN 4

Line 58, "is" should read --in--.

COLUMN 5

Line 15, after "on" insert --the--.

Line 61, "thee" should read --the--.

COLUMN 6

Line 27, "explained are" should read --are explained--.

Line 44, after "and" insert --the--.

COLUMN 7

Line 56, "given are" should read --are given--.

Line 58, after "number" insert --the--.

COLUMN 8

Line 8, ", "20-13",...)," should read --, "20-13",...,--

UNITED STATES PATENT AND TRADEMARK OFFICE

CERTIFICATE OF CORRECTION

PATENT NO. : 4,437,756

DATED : March 20, 1984

INVENTOR(S) : KAZUO KAWAKUBO, ET AL.

It is certified that error appears in the above-identified patent and that said Letters Patent is hereby corrected as shown below:

COLUMN 8

Line 19, ", "15-2",...)," should read --, "15-2",...,--.

Line 35, "subsequently" should read --subsequent--.

Line 52, delete "37".

Line 53, "20-20"" should read --"20-20"--.

COLUMN 9

Line 34, "by the" should read --for--.

Line 50, after "in" insert --the--.

COLUMN 10

Line 20, after "number" (second occurrence) insert --the--.

Line 60, "direct-y" should read --directly--;
after "of" insert --the--.

COLUMN 11

Line 19, "to obtain" should read --obtaining--.

COLUMN 12

Line 18, "on" should read --of--.

Line 43, ""25"" should read --"025"--.

COLUMN 13

Line 62, "step key" should read --stop key--.

UNITED STATES PATENT AND TRADEMARK OFFICE

CERTIFICATE OF CORRECTION

PATENT NO. : 4,437,756

DATED : March 20, 1984

INVENTOR(S) : KAZUO KAWAKUBO, ET AL.

It is certified that error appears in the above-identified patent and that said Letters Patent is hereby corrected as shown below:

COLUMN 15

Line 5, "being" should read --is--.

COLUMN 17 (Claim 6, Line 27)

Line 12, "made" should read --mode--.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*